United States Patent [19]

Wachi et al.

[11] Patent Number: 5,027,690

[45] Date of Patent: Jul. 2, 1991

[54] ELECTRONIC MUSICAL KEYBOARD INSTRUMENTS WITH VARIABLE TOUCH SENSITIVITY

[75] Inventors: Masatada Wachi; Naota Katada; Kosei Terada; Takeshi Adachi; Takaaki Mutoh, all of Hamamatsu, Japan

[73] Assignee: Nippon Gakki Seizo Kabushiki Kaisha, Hamatsu, Japan

[21] Appl. No.: 325,110

[22] Filed: Mar. 17, 1989

Related U.S. Application Data

[63] Continuation of Ser. No. 13,695, Feb. 12, 1987, abandoned.

[30] Foreign Application Priority Data

Feb. 12, 1986 [JP] Japan ..... 61-29640
Feb. 13, 1986 [JP] Japan ..... 61-29824

[51] Int. Cl.[5] ..... G10H 7/00

[52] U.S. Cl. ..... 84/626; 84/622; 84/629; 84/658; 84/662

[58] Field of Search ..... 84/615, 622, 626–627, 84/629, 634, 658, 678, 687, 692, 701, 702, DIG. 7, 662

[56] References Cited

U.S. PATENT DOCUMENTS 4,148,239 2/1979 Oya et al. ..... 84/1.24 X
4,172,403 10/1979 Campbell et al. ..... 84/1.28
4,503,745 3/1985 Clark, Jr. et al. ..... 84/1.1
4,528,885 7/1985 Chihana ..... 84/1.1
4,628,785 12/1986 Buchla ..... 84/DIG. 7 X
4,628,786 12/1986 Buchla ..... 84/DIG. 7 X
4,646,609 3/1987 Teruo et al. ..... 84/DIG. 7 X
4,681,008 7/1987 Morikawa et al. ..... 84/1.01 X
4,699,038 10/1987 Wedge ..... 84/1.1
4,939,973 7/1990 Suzuki ..... 84/626 X
4,972,753 11/1990 Adachi et al. ..... 84/626

FOREIGN PATENT DOCUMENTS 0003319 1/1978 Japan ..... 84/1.27

*Primary Examiner*—A. T. Grimley
*Assistant Examiner*—Matthew S. Smith
*Attorney, Agent, or Firm*—Blakely, Sokoloff, Taylor & Zafman

[57] ABSTRACT

An electronic musical instrument having a keyboard, includes a plurality of keys, a plurality of musical tone signal generation systems, a touch detector for producing touch data representing a key touch accompanied by a key depression, a panel operation unit for setting a touch sensitivity representing a sensitivity with respect to a key touch for each of the musical tone signal generation systems, and a register unit for modifying the touch data in accordance with the touch sensitivity corresponding to each of the musical tone signal generation systems. Different tone groups are assigned to the musical tone signal generation systems, and a musical tone signal which has a tone color belonging to the corresponding musical tone group and a pitch corresponding to a key depression is produced from each of the musical tone signal generation systems. Each musical tone group includes at least two tone colors having a common attribute. The musical tone signals from the corresponding musical tone signal generation systems are controlled in accordance with the modified touch data corresponding to the musical tone signal generation systems obtained from the register unit.

13 Claims, 25 Drawing Sheets

ELECTRONIC MUSICAL KEYBOARD INSTRUMENTS WITH VARIABLE TOUCH SENSITIVITY

This is a continuation of application Ser. No. 013,695, filed Feb. 12, 1987, now abandoned.

BACKGROUND OF THE INVENTION

The present invention relates to an electronic musical instrument which has an improved touch response function.

Typical electronic musical instruments have an initial touch response function for controlling a tone volume and a tone color in accordance with a key depression speed and an after touch response function for controlling a tone volume and a tone color in accordance with a key depression strength during key depression. Thus, delicate expressions can be added to musical tones produced upon key operations of a performer.

Upon performance of an acoustic musical instrument, when a variety of operation methods are adopted, various expressions can be provided to musical tones produced therefrom. The electronic musical instrument can realize a performance expression resembling that of acoustic musical instruments by means of the touch response function described above.

A conventional electronic musical instrument which weights touch data detected upon key operation in correspondence with a tone color has been proposed, as disclosed in Japanese Publication No. 59-113493. When the tone color of a musical tone changes, the sensitivity of a touch response (to be referred to as a touch sensitivity hereinafter) is updated accordingly, thereby providing a touch response effect to the musical tone as natural as possible.

However, in the conventional electronic musical instrument, the touch sensitivity of the touch response is fixed as data (factory set data) which has been preset in a factory upon manufacture of the electronic musical instrument. Therefore, even if a performer wants to perform music by changing a touch sensitivity as needed, the touch response function does not provide satisfactory effects for the performer who needs full expressions.

SUMMARY OF THE INVENTION

It is a principal object of the present invention to provide an electronic musical instrument with which a performer can select a desirable touch sensitivity, thereby allowing wide performance expressions.

It is another object of the present invention to provide an electronic musical instrument which can control a vibrato effect using after touch data.

It is still another object of the present invention to provide an electronic musical instrument which can provide a wide variety of performance expressions.

According to an aspect of the present invention, there is provided an electronic musical instrument having a keyboard, comprising: a plurality of keys; a plurality of musical tone signal generation systems, to which different tone groups are assigned respectively for respectively generating musical tone signals each having a tone pitch corresponding to a depressed key among the keys and having a tone color belonging to the assigned tone group, each of the tone groups including at least two tone colors having a common attribute; touch data producing means for producing touch data representing a degree of depression of the depressed key; touch sensitivity setting means for setting respectively touch sensitivities representing sensitivity to a key touch for the musical tone signal generation systems; touch data modifying means for modifying the touch data in accordance with each of the touch sensitivity and for delivering modified touch data for each of the musical tone signal generating systems; and control means for controlling a characteristic of each of the musical tone signals in accordance with corresponding one of the modified touch data.

According to another aspect of the present invention, there is provided an electronic musical instrument having a keyboard, comprising: a plurality of keys; touch data generating means for generating touch data representing a degree of depression of a depressed key; value setting means for setting first and second values; touch sensitivity setting means for setting a touch sensitivity representing a sensitivity to a key touch, an upper-limit and a lower-limit of the touch sensitivity corresponding to the first value and the second value respectively; touch data modifying means for modifying the touch data in accordance with the touch sensitivity and for delivering modified touch data; musical tone signal generating means for generating a musical tone signal having a pitch corresponding to the depressed key; and control means for controlling a characteristic of the musical tone signal in accordance with the modified touch data.

DESCRIPTION OF THE PREFERRED EMBODIMENTS

An embodiment of the present invention will now be described with reference to the accompanying drawings.

Figure 1:
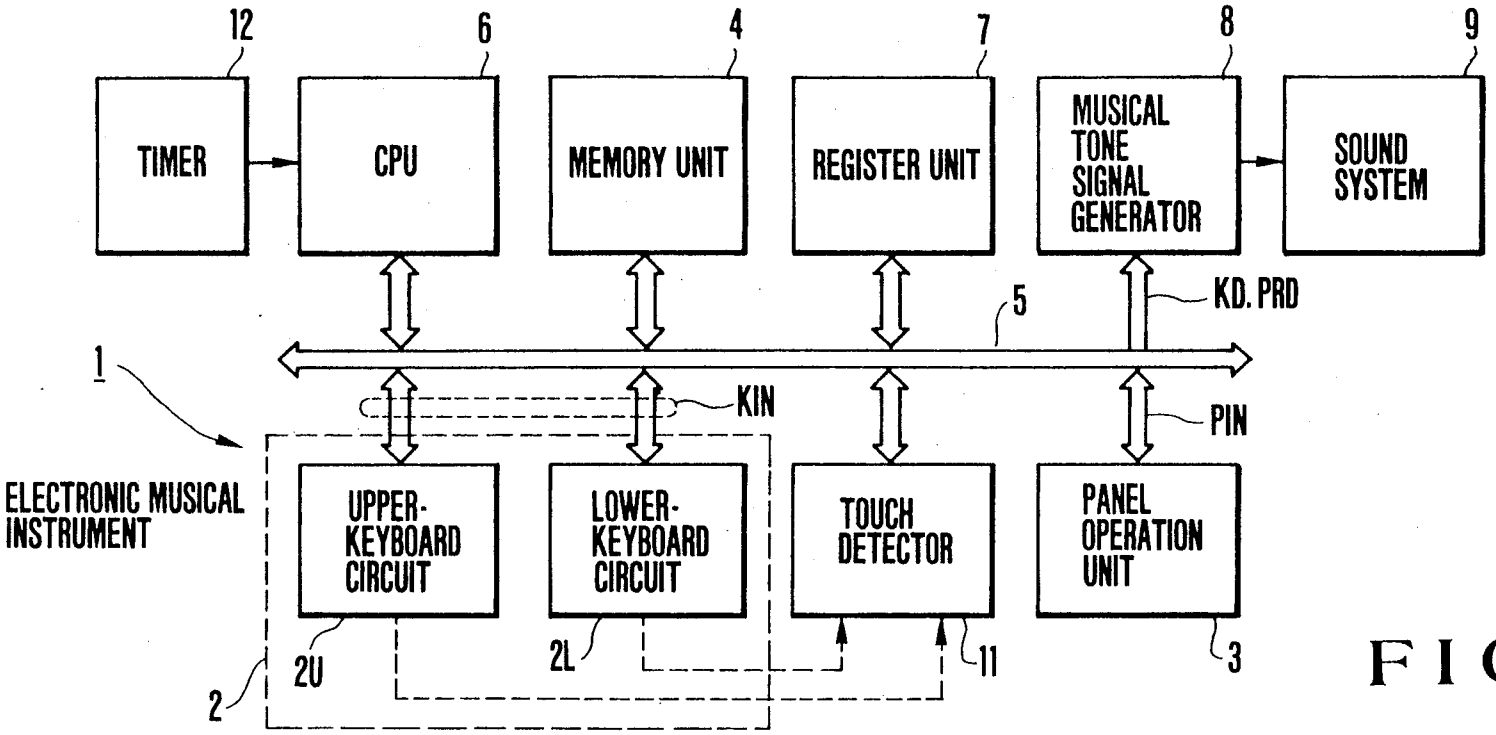
FIG. 1 is a block diagram showing an electronic musical instrument according to an embodiment of the present invention
Figure 2:
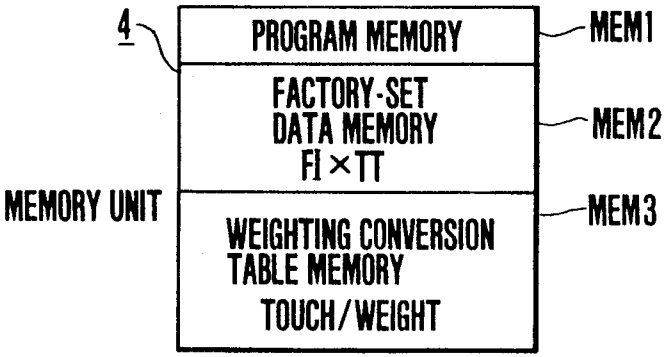
FIG. 2 is a memory map of a memory unit 4.

Referring to FIG. 1, reference numeral 1 denotes an electronic musical instrument as a whole. A keyboard unit 2 includes an upper keyboard circuit (including an upper keyboard) 2U and a lower keyboard circuit (including a lower keyboard) 2L. Key information KIN supplied from the keyboard unit 2 and a panel information PIN supplied from a panel operation unit 3 are stored in a register unit 7, which comprises a RAM, through a data bus 5 under the control of a central processing unit (CPU) 6. The CPU 6 executes a program stored in a program memory MEM1 (FIG. 2) of a memory unit 4 which comprises a ROM.

The CPU 6 executes predetermined data processing of these information, and supplies resultant key data KD and parameter data PRD to a musical tone generator (TG) 8 through the bus 5. The musical tone generator 8 produces a musical tone signal designated by the key data KD and the parameter data PRD and supplies it to a sound system 9. The sound system 9 converts the musical tone signal into a corresponding musical tone.

In this embodiment, the musical tone generator 8 has two musical tone generation systems corresponding to the upper and lower keyboards. The first musical tone signal generation system generates musical tone signals having tone colors (e.g., a violin, flute, and the like) which belong to a continuous tone group composed of continuous tones (to be referred to as an orchestra tone group). The second musical tone signal generation system generates musical tone signals having tone colors (e.g., a piano, guitar, and the like) which belong to a percussive tone group composed of percussive tones (to be referred to as a special tone group).

The musical tone generator 8 can generate four tone groups of musical tone signals. The four tone groups is composed of a first tone group consisting of an upper-keyboard orchestra tone group (UO), a second tone group consisting of an upper-keyboard special tone group (US), a third tone group consisting of a lower-keyboard orchestra tone group (LO), and a fourth tone group consisting of a lower-keyboard special tone group (LS).

A touch detector 11 is arranged in association with keys of the upper and lower keyboard circuits 2U and 2L of the keyboard unit 2. When a key of the upper or lower keyboard circuit 2U or 2L is depressed, the detector 11 detects a depression speed for the key, and generates initial touch response data representing the detected depression speed. The touch detector 11 also generates after-touch response data representing a depression strength or a depression force during key depression for each keyboard.

Figure 3:
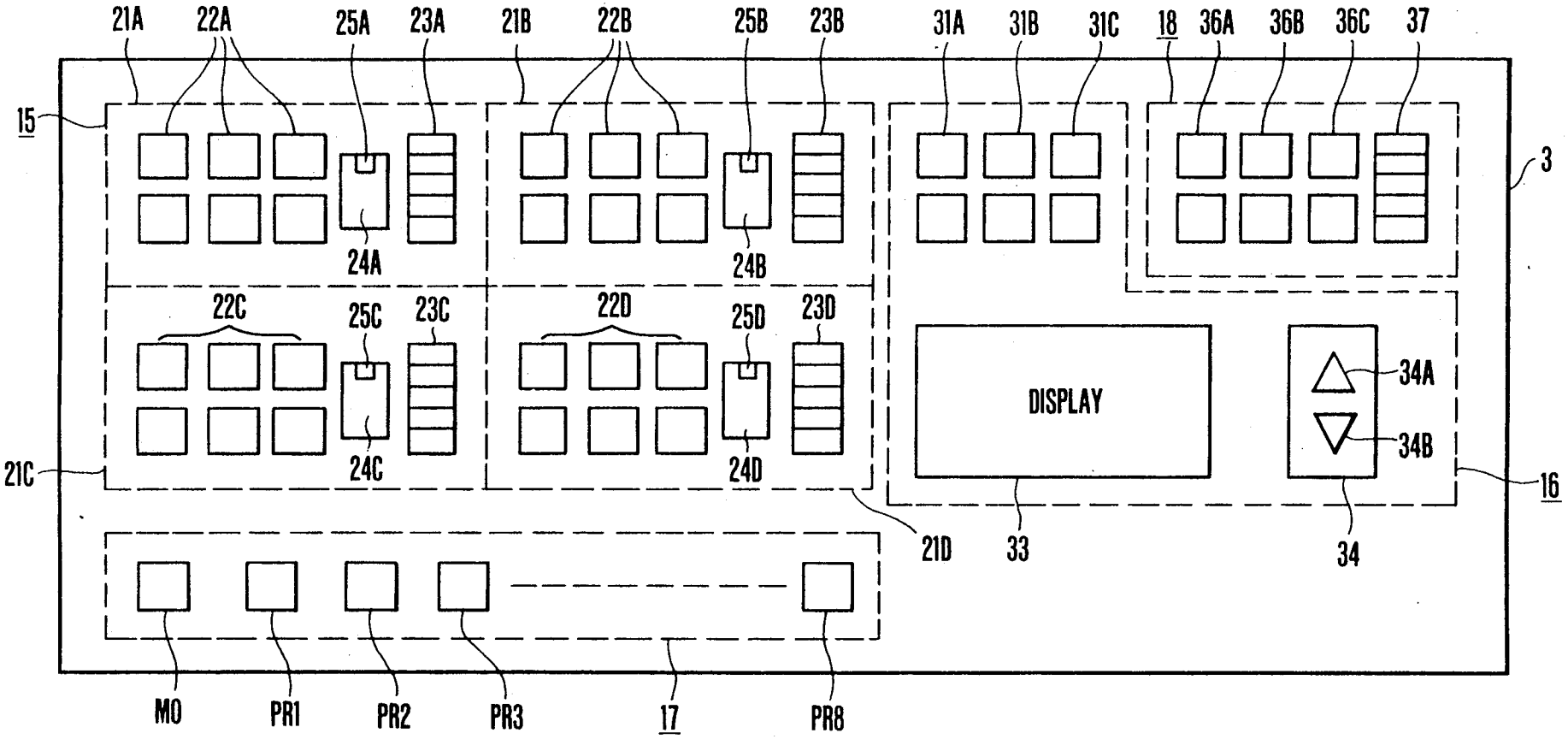
FIG. 3 is an illustration showing the arrangement of a panel operation unit 3.

The panel operation unit 3 is disposed on the operation panel of the electronic musical instrument together with the upper and lower keyboards of the keyboard unit 2. As shown in FIG. 3, the unit 3 has a tone group setting section 15 capable of setting parameters for each tone group, a multi-menu setting section 16 capable of inputting numerical data for setting parameters, a preset section 17 which is operated when data set by the tone group setting section 15 and the multi-menu setting section 16 is stored in first to eighth preset registers REG21 to REG28 of the register unit 7 (FIG. 4), and an operation member group 18 consisting of other switches and a tone volume control.

Each musical tone signal generating system has a tone color designating switch, a touch tone designating switch, and a tone volume control.

First to fourth musical tone setting sections 21A to 21D respectively set data corresponding to the first to fourth tone groups, and respectively comprise tone color designating switches 22A to 22D, tone volume controls 23A to 23D each comprising a multi-step switch structure, and touch tone designating switches 24A to 24D.

The tone color designating switches 22A to 22D and the tone volume controls 23A to 23D of the first to fourth tone group setting sections 21A to 21D are operated when the tone colors and the tone volumes of musical tone signals which are respectively generated from the first to fourth tone groups are input.

The touch tone designating switches 24A to 24D of the first to fourth tone group setting sections 21A to 21D can select whether factory set data which is preset in a factory (to be referred to as a factory-set performance mode hereinafter) or data set by a performer (to be referred to as a performer-set performance mode hereinafter) is used as a touch sensitivity. The switches 24A to 24D each comprise self-return type switches. In this embodiment, when the touch tone designating switches 24A to 24D are turned on (to be referred to as an on-event hereinafter), an operating mode, which provides a touch response using data of a touch sensitivity set by a performer, can be designated. At this time, display elements 25A to 25D arranged on the key tops of the switches 24A to 24D are turned on, so as to indicate that the performer-set performance mode is set. The display elements 25A to 25D each comprise LEDs (light-emitting diodes).

Figure 4:
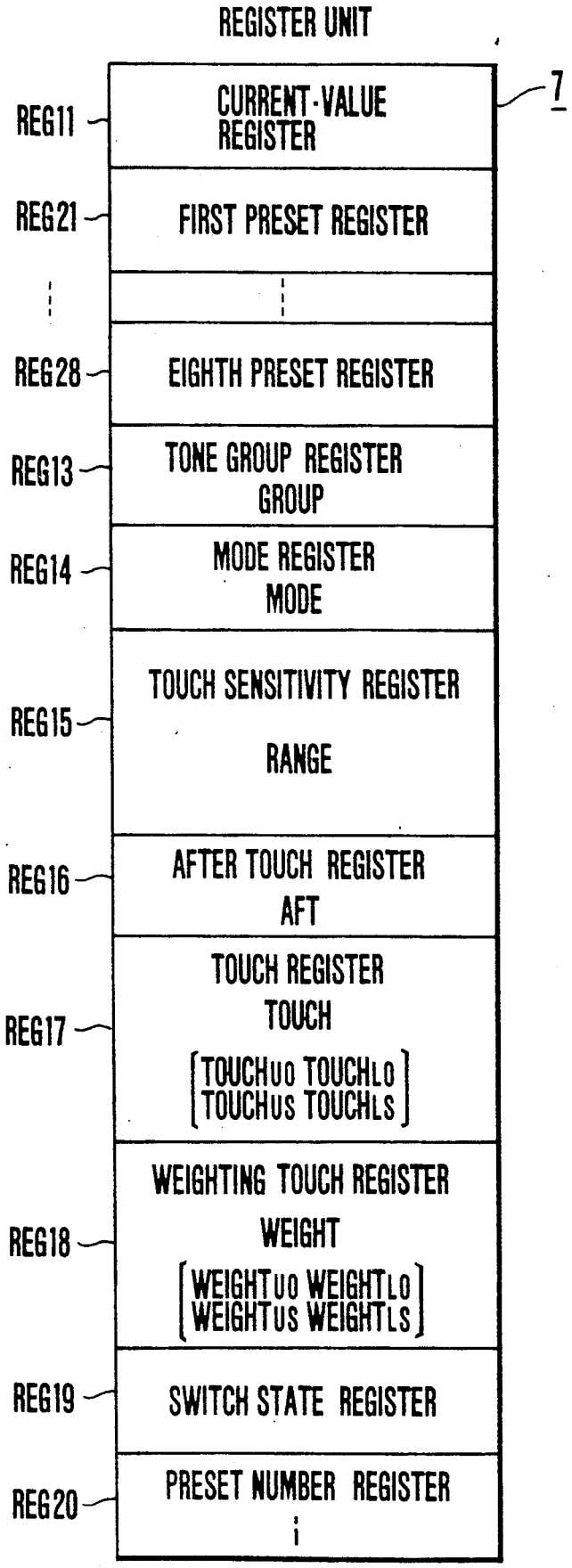
FIG. 4 is a memory map of a register unit 7.

The CPU 6 writes setting data input by the tone group setting section 15 in a current-value register REG11 of the register unit 7 (FIG. 4).

The multi-menu setting section 16 is used when the performer sets numerical data of various parameters other than the musical tones and tone volumes. The section 16 has mode selection switches 31A, 31B, 31C, . . . , corresponding to the types of parameters which are set by the performer, a display 33 for displaying the setting value of a parameter, and an up/down switch 34 (constituted by an up switch 34A and a down switch 34B).

Operating modes for setting parameters associated with, e.g., a vibrato speed, a vibrato depth, . . . , are assigned to the mode selection switches 31A, 31B, 31C, . . . as first, second, third parameter setting modes, . . . . The CPU 6 writes mode data MODE representing the selected setting mode in a mode register REG14 of the register unit 7 (FIG. 4). In this case, the setting mode of a parameter associated with the touch sensitivity is selected by the touch tone designating switches 24A to 24D. Therefore, when the performance setting mode is selected by the switches 24A to 24D, the mode data MODE represents the setting mode of the parameter associated with the touch sensitivity. For this reason, the mode selection switches 31A, 31B, 31C, . . . do not include a switch for designating the parameter associated with the touch sensitivity. When the mode data MODE is written in the mode register REG14, the CPU 6 causes the display 33 to display the content of a parameter as an object of the setting mode represented by the data MODE. The CPU 6 enters a subroutine for input processing of numerical data in the selected setting mode, and executes processing steps for increasing or decreasing current-value data of the parameter stored in a current-value register REG11 of the register unit 7 in accordance with the operating state of the up/down switch 34.

The operation member group 18 has switches 36A, 36B, 36C, . . . , comprising, e.g., a rhythm selection switch, and a master control 37 having a multi-step switch structure. The CPU 6 writes the input data from the group 18 in the current-value register REG11. The master control 37 can control the total musical tone volume of the electronic musical instrument as a whole.

Figure 5A:
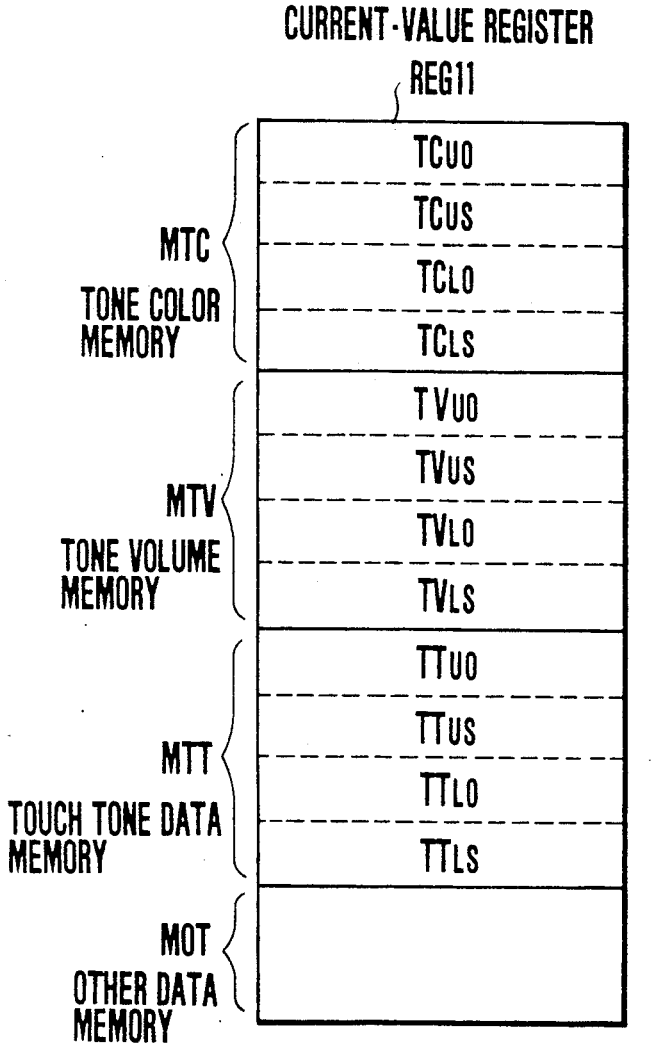
FIGS. 5A and 5B are detailed memory maps of a current value register REG11 shown in FIG. 4.

The current-value register REG11 of the register unit 7 has a tone color memory MTC, a tone volume memory MTV, a touch tone data memory MTT, and memory MOT for other data, as shown in FIG. 5.

When the tone color designating switches 22A to 22D of the first to fourth tone group setting sections 21A to 21D are operated, the tone color memory MTC stores corresponding tone color code data $TC_{UO}$, $TC_{US}$, $TC_{LO}$, and $TC_{LS}$ for each tone group.

When the tone volume controls 23A to 23D of the first to fourth tone group setting sections 21A to 21D are operated, the tone volume memory MTV stores corresponding tone volume data $TV_{UO}$, $TV_{US}$, $TV_{LO}$, and $TV_{LS}$ for each tone group.

Figure 5B:
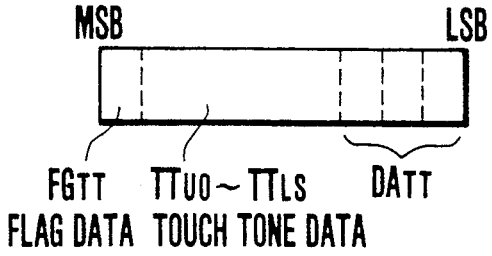

The touch tone data memory MTT stores touch tone data $TT_{UO}$, $TT_{US}$, $TT_{LO}$, and $TT_{LS}$ corresponding to the touch tone designating switches 24A to 24D of the first to fourth tone group setting sections 21A to 21D for each tone group. In this embodiment, the touch tone data $TT_{UO}$, $TT_{US}$, $TT_{LO}$, and $TT_{LS}$ each have touch tone flag data $FG_{TT}$ at the positions of the most significant bits MSB, as shown in FIG. 5(B). The touch tone data $TT_{UO}$, $TT_{US}$, $TT_{LO}$, and $TT_{LS}$ each have touch sensitivity data $DA_{TT}$, which is set by the performer, at the positions of the lower 3 bits. The flag data $FG_{TT}$ indicates whether or not the performer-set performance mode is selected by the touch tone designating switches 24A to 24D.

Figure 6:
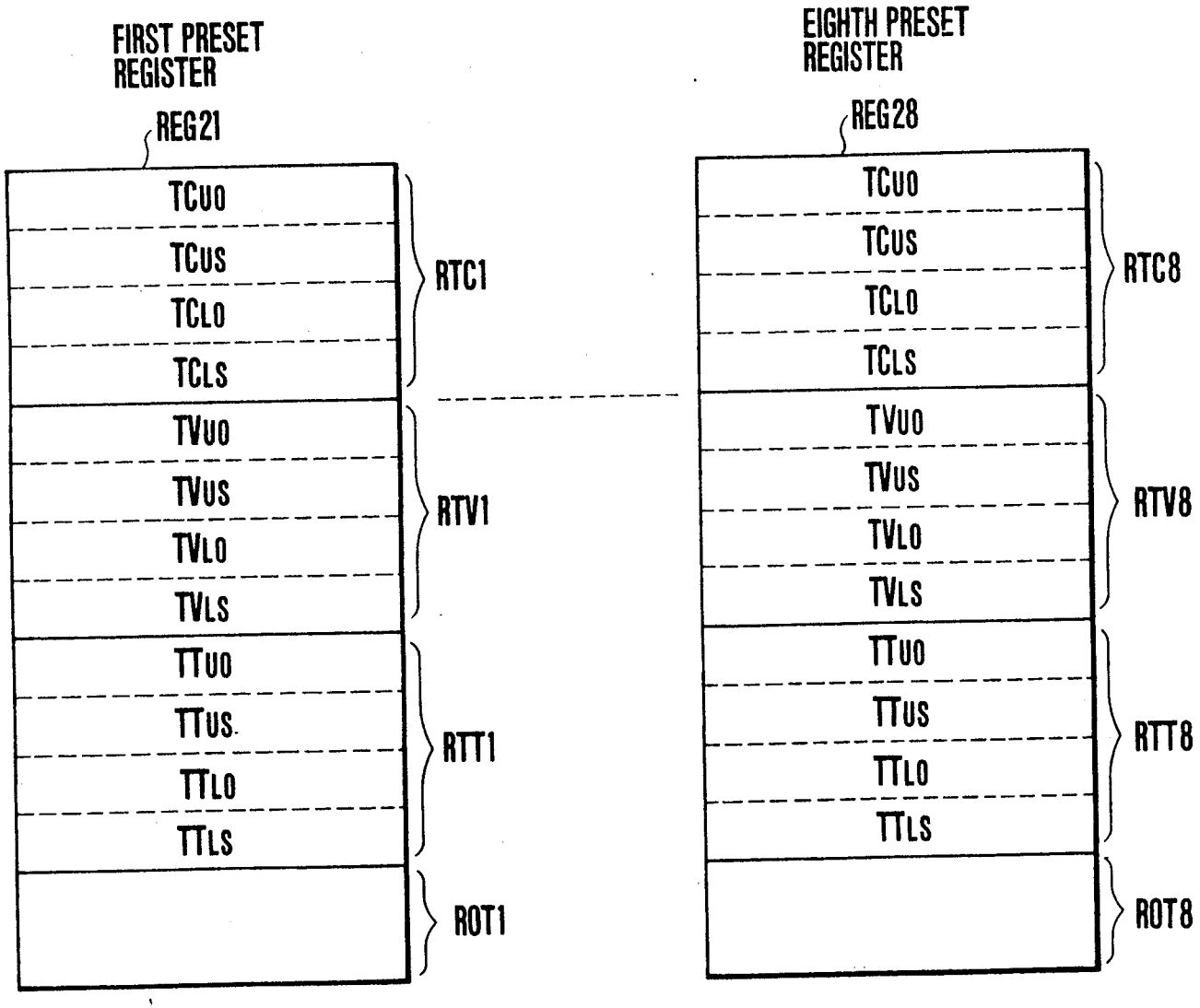
FIG. 6 is a detailed memory map of preset registers REG21 to REG28.

The preset registers REG21 to REG28 have tone color memories RTC1 to RTC8, tone volume memories RTV1 to RTV8, touch tone data memories RTT1 to RTT8, and memories ROT1 to ROT8 for other data in correspondence with the current-value register REG11, as shown in FIG. 6. When a preset unit 17 of the panel operation unit 3 is operated, these memories communicate all the data with the current-value register REG11.

The preset unit 17 has preset switches PR1 to PR8 corresponding to eight preset registers REG21 to REG28, and a write switch M0. When the preset switches PR1 to PR8 are selectively turned on while the write switch M0 is kept on, the CPU 6 transfers the data stored in the current-value register REG11 to the preset register corresponding to the preset switch which is currently turned on. When the preset switches PR1 to PR8 are selectively turned on while the write switch M0 is kept off, the CPU 6 transfers data of the corresponding preset register to the current-value register REG11.

The register unit 7 has registers REG13 to REG20 in addition to the registers described above, as shown in FIG. 4.

The switch state register REG 19 has 1-bit memory areas for all the switches (of self return type) arranged on the panel operation unit 3, and stores the ON/OFF state of each switch by inverting the data in the corresponding memory area upon operation of the switch.

When the performer operates a switch included in the first to fourth tone group setting sections 21A to 21D, the tone group register REG13 stores code data assigned to the operated tone group setting section, and also stores data representing the tone group the performer selected.

The mode register REG14 stores the above-mentioned mode data MODE representing the parameter setting mode which can be set by the multi-menu setting section 16.

The touch sensitivity register REG15 stores data RANGE representing a value of the touch sensitivity which is set by the performer using the up/down switch 34.

The after-touch register REG16 stores after-touch data AFT consisting of detection data which is obtained by the touch detector 11 when the performer changes a depression force with respect to the key in order to provide an after-touch response effect. In this embodiment, the after-touch data AFT is detected for each the upper and lower keyboards. Thus, two data $AFT_U$ and $AFT_L$ are written in the after-touch register REG16.

The touch register REG17 stores touch data TOUCH associated with initial touch data INT and after-touch data AFT which are obtained from the touch detector 11 corresponding to the initial touch operation and the after-touch operation. In practice, the touch register REG17 has memory areas for storing data $TOUCH_{UO}$, $TOUCH_{US}$, $TOUCH_{LO}$, and $TOUCH_{LS}$ for each tone group.

In this embodiment, only after-touch response control is enabled for the upper- and lower-keyboard orchestra tone groups UO and LO. Conversely, only initial touch response control is enabled for the upper- and lower-keyboard special tone groups US and LS. For this reason, the touch data $TOUCH_{UO}$ and $TOUCH_{LO}$ corresponding to the upper- and lower-keyboard orchestra tone groups UO and LO respectively correspond to the upper- and lower-keyboard after-touch data AFT. On the other hand, the touch data $TOUCH_{US}$ and $TOUCH_{LS}$ corresponding to the upper- and lower-keyboard special tone groups US and LS respectively correspond to upper- and lower-keyboard initial touch data INT.

The weighting touch register REG18 stores weighted touch data WEIGHT obtained from a weighting conversion table memory MEM3. In practice, the weighting touch register REG18 has memory areas for storing data $WEIGHT_{UO}$, $WEIGHT_{US}$, $WEIGHT_{LO}$, and $WEIGHT_{LS}$ for each tone group.

When one of the preset registers REG21 to REG28 is selected by the preset switches PR1 to PR8, the preset number register REG20 stores preset number data (indicated by i) representing the selected register number i.

The memory unit 4 (FIG. 2) has the following memories in addition to the above-mentioned program memory MEM1.

Figure 7:
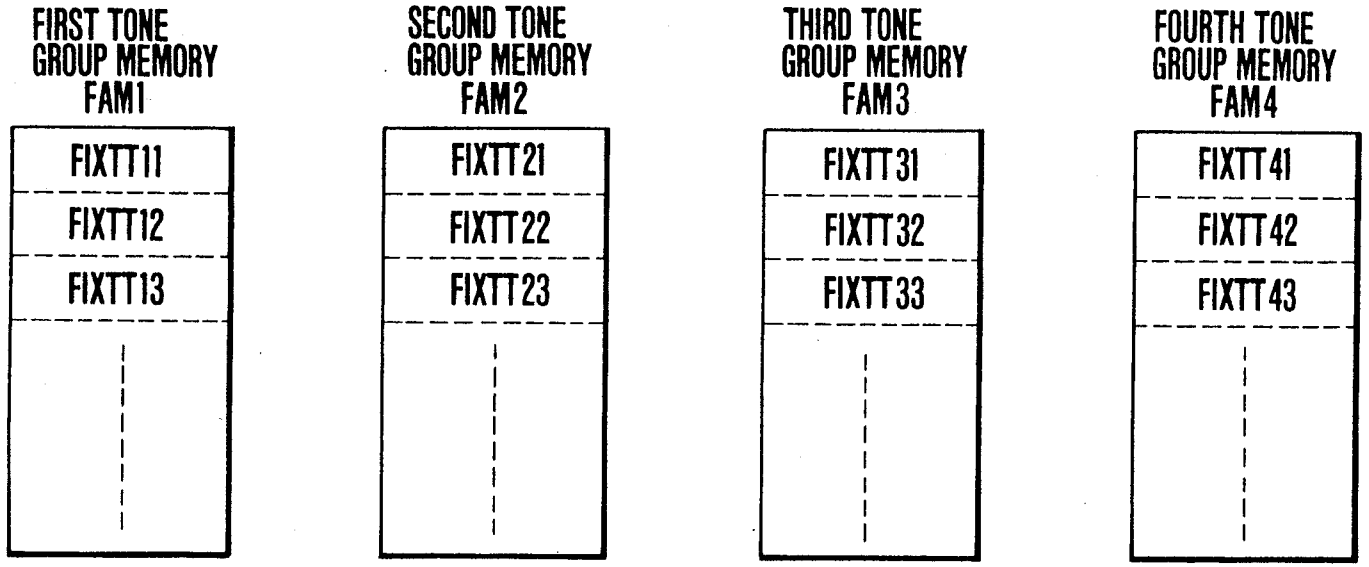
FIG. 7 is a detailed memory map of a factory set data memory shown in FIG. 2.

A factory set data memory MEM2 stores factory-set touch sensitivity data FIXTT which is set when the electronic musical instrument is manufactured in a factory, and has tone group memories FAM1 to FAM4 (FIG. 7) corresponding to the first to fourth tone group setting sections 21A to 21D. The tone group memories FAM1 to FAM4 prestore predetermined factory-set touch sensitivity data FIXTT (i.e., FIXTT11, FIXTT12, . . . , FIXTT41, FIXTT42, . . . ) for each tone color designated by the tone color designating switches 22A to 22D of the first to fourth tone group setting sections 21A to 21D.

When the performer turns off the touch tone designating switches 24A to 24D to designate the factory-set performance mode, the factory-set touch sensitivity data FIXTT corresponding to a tone color designated by the performer for each tone group is read out from the factory set data memory MEM2. Thus, in the factory-set performance mode, a touch response is provided using the factory-set data touch sensitivity data FIXTT.

Figure 8:
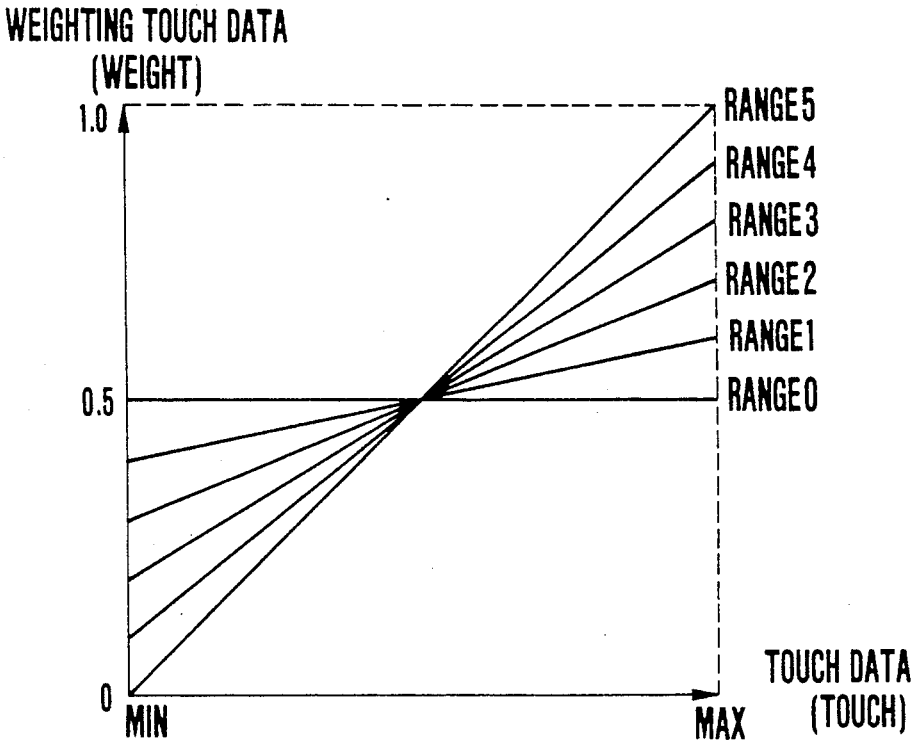
FIG. 8 is a graph for explaining conversion data of a weighting conversion table memory MEM3.

A weighting conversion table memory MEM3 converts the touch data TOUCH written in the touch register REG17 of the register unit 7 into weighted touch data WEIGHT which is changed at a changing rate determined by the touch sensitivity data RANGE written in the touch sensitivity register REG15. As shown in FIG. 8, when the touch data TOUCH changes from its minimum value MIN to its maximum value MAX, the touch data TOUCH is converted to the weighted touch data WEIGHT, so that the weighted touch data WEIGHT linearly increases from 0 to 1.

The linear changing rate can be determined by the value of the touch sensitivity data RANGE written in the touch sensitivity data REG15. In this embodiment, six steps of touch sensitivities can be set within the range of a minimum value RANGE0 to a maximum value RANGE5.

When the minimum touch sensitivity RANGE0 is set, even if the touch data TOUCH changes, the weighted touch data WEIGHT does not change and takes a constant value (0.5). When the maximum touch sensitivity RANGE5 is set, the weighted touch data WEIGHT maximumally changes (i.e., from 0 to 1) upon change in touch data TOUCH. When the touch sensitivities RANGE1, RANGE2, RANGE3, and RANGE4 between the minimum and maximum touch sensitivities RANGE0 and RANGE5 are selected, the inclination of the weighted touch data WEIGHT is set between the constant value and the maximum inclination.

In this way, when the performer selects one of the touch sensitivities RANGE0 to RANGE5, the weighting conversion table memory MEM3 is accessed by using the touch sensitivity data RANGE and the touch data TOUCH. Thus, the touch data TOUCH is converted into weighted touch data WEIGHT in accordance with a line (function) designated by the touch sensitivity data RANGE.

Figure 9:
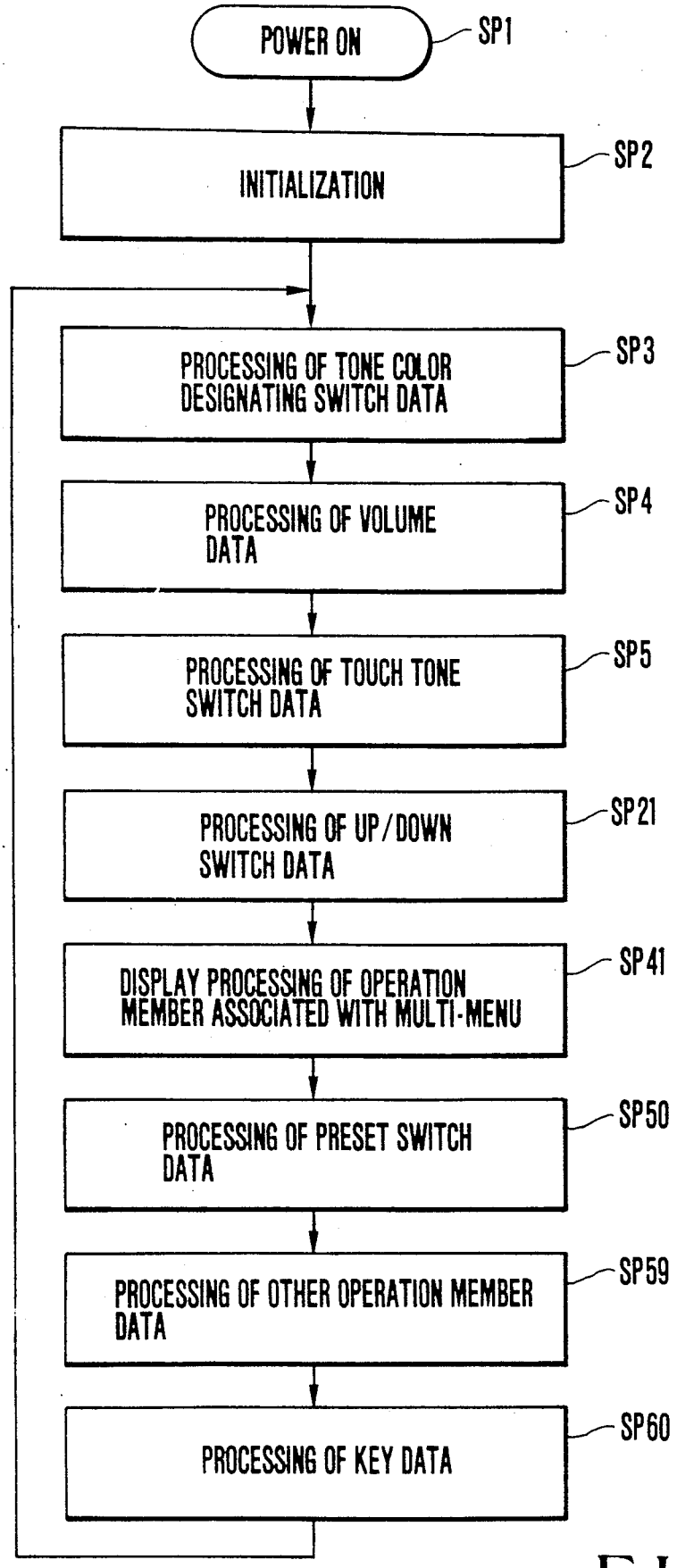
FIG. 9 is a flow chart showing a main routine that is executed by a CPU 6 shown in FIG. 1.

The CPU 6 executes the main routine shown in FIG. 9 in response to the supply of the power source to the electronic musical instrument. More specifically, if the power source is turned on in step SP1, the CPU 6 executes an initialization routine in step SP2, thereby initializing the electronic musical instrument as a whole.

Thereafter, when the performer operates the operation members consisting of the switches and the tone volume control of the panel operation unit 3, or when he operates the keys of the keyboard unit 2, the CPU 6 executes input data processing associated with the operations of switches or keys.

More specifically, each switch (the self-return switch) on the panel operation unit 3 is scanned, and the scan result is written in the switch state register REG19 of the register unit 7, thereby storing the current switch operating state. Upon the next switch scan, a new scan result is compared with the preceding scan result stored in the register REG19 so as to discriminate whether the switch corresponds to an on- or off-event. Then, the CPU 6 executes a data processing program corresponding to the discriminated switch event.

PROCESSING OF TONE COLOR DESIGNATING SWITCH DATA

In the main routine shown in FIG. 9, in step SP3, when the tone color designating switches 22A to 22D of the tone group setting unit 15 are scanned and an on-event thereof is detected, the CPU 6 writes one of the tone color code data $TC_{UO}$ to $TC_{LS}$ corresponding to the tone color designating switch in the tone color memory MTC of the current-value register REG11. In addition, the CPU 6 transfers the written tone color code data to the musical tone signal generator 8 as the parameter data PRD, thereby controlling the tone color of the musical tone signal generation system of the corresponding tone group.

PROCESSING OF VOLUME DATA

The CPU 6 executes a volume data processing routine in step SP4. In step SP4, the tone volume controls 23A to 23D of the first to fourth tone group setting sections 21A to 21D arranged on the panel operation unit 3 are scanned, the CPU 6 writes one of the tone volume data $TV_{UO}$ to $TV_{LS}$ designated by the corresponding one of the controls 23A to 23D in the tone volume memory MTV, and transfers the tone volume data to the musical tone signal generator 8 as the parameter data PRD, thereby controlling the tone volume of the musical tone signal of each tone group. The control operation of the tone volume can be realized by an arrangement in which the tone volume data is multiplied with an envelope waveform.

PROCESSING OF TOUCH TONE SWITCH DATA

The CPU 6 executes the processing of the touch tone switch data in step SP5 of the main routine. In step SP5, when the CPU 6 scans the touch tone designating switches 24A to 24D of the first to fourth tone group setting sections 21A to 21D and detects an on-event of any of these switches, it executes processing steps in FIG. 10.

Figure 10:
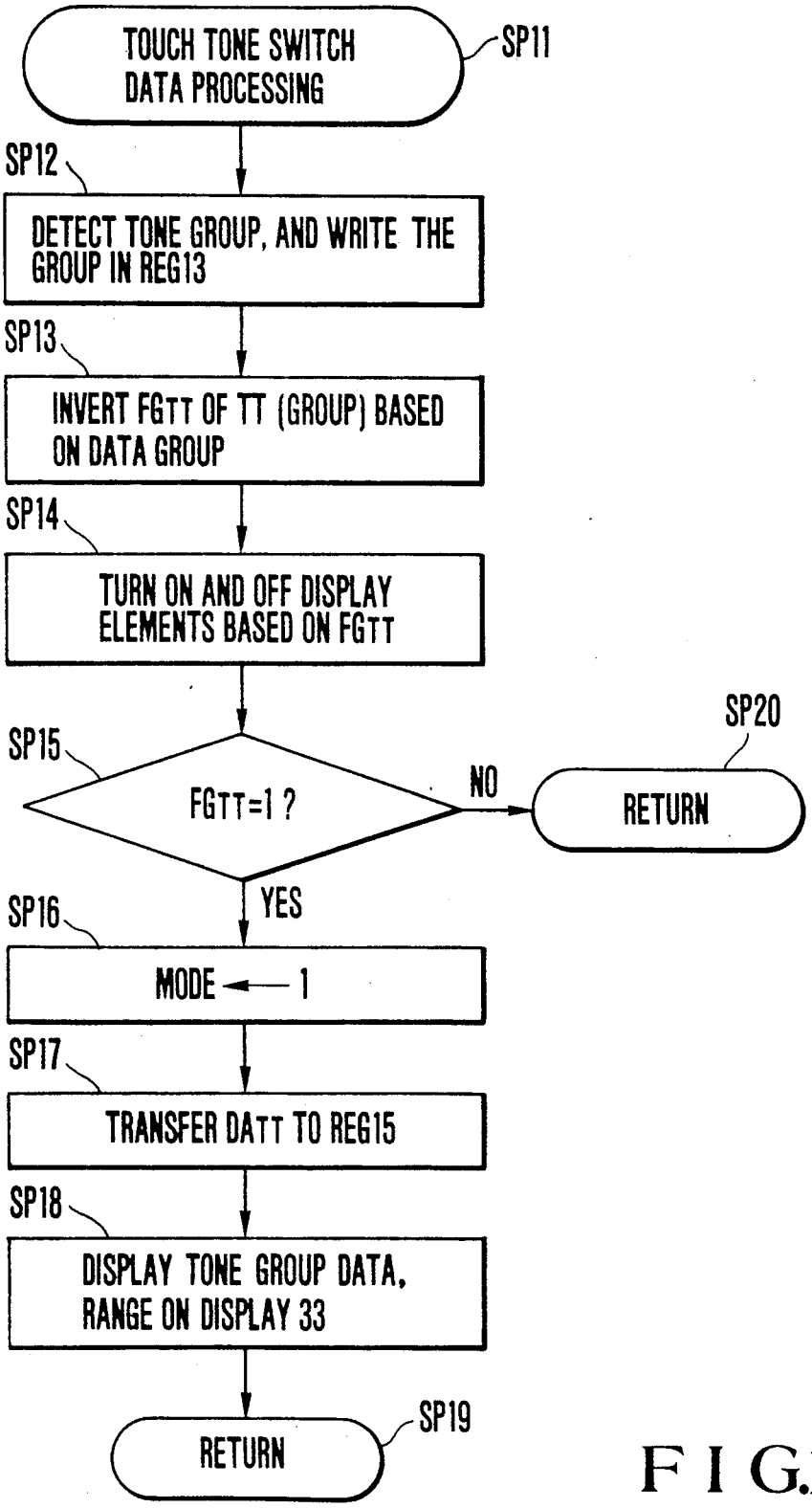
FIGS. 10 to 16 are flow charts showing subroutines.

In step SP12 in FIG. 10, when the control enters the touch tone switch data processing program, the CPU 6 detects the tone group to which the touch tone switch corresponding to the on-event belongs, and writes tone group data GROUP representing the corresponding tone group in the tone group register REG13.

Subsequently, in step SP13, the CPU 6 reads out the corresponding touch tone data TT(GROUP) from the touch tone data $TT_{UO}$ to $TT_{LS}$ stored in the touch tone data memory MTT of the current-value register REG11, and inverts the logic level of the flag data $FG_{TT}$ (FIG. 5(B)) of the readout data. When the logic level of the flag data $FG_{TT}$ is inverted from logic "0" to logic "1", this represents that touch response is controlled in the performer-set performance mode using the touch sensitivity data which is set by the performer. On the contrary, if the logic level of the flag data $FG_{TT}$ is inverted from logic "1" to logic "0", this represents that touch response is controlled in the factory-set performance mode using the touch sensitivity data which is preset in the factory. Therefore, in step SP14, the CPU 6 turns on or off the display elements 25A to 25D of the corresponding tone groups in accordance with logic "1" or "0" of the flag data $FG_{TT}$, so as to indicate the performance mode of the corresponding tone group to the performer. Thereafter, the flow advances to step SP15.

It is checked in step SP15 if the flag data $FG_{TT}$ after inversion is at logic "1". If YES in step SP15, the CPU 6 writes the mode data MODE indicating "mode number 1" in the mode register REG14 of the register unit 7, in step SP16. Then, in step SP17, the CPU 6 writes in the touch sensitivity register REG15 the touch sensitivity data $DA_{TT}$ (FIG. 5(B)) assigned to the lower 3 bits of the touch tone data TT(GROUP) of the corresponding tone group as the touch sensitivity data RANGE. The CPU 6 sends the tone group data GROUP stored in the tone group register REG13 and the touch sensitivity data RANGE stored in the touch sensitivity register REG15 to the display 33 of the multi-menu setting unit 16, thereby displaying the tone group name and the touch sensitivity of the corresponding tone group.

When one of the touch tone switches 24A to 24D is turned on and the performer-set performance mode is set, the CPU 6 turns on the corresponding one of the display elements 25A to 25D, and displays on the display 33 the tone group with which the performer-set performance mode is set and the touch sensitivity which is set for the corresponding tone group. Thereafter, the CPU 6 ends the touch tone switch data processing program in step SP19, and the flow then returns to the main routine.

In contrast to this, if NO in step SP15, the CPU 6 ends the program in step SP20, and the flow returns to the main routine.

PROCESSING OF UP/DOWN SWITCH DATA

The CPU 6 executes the processing program of the up/down switch data in step SP21 of the main routine.

Figure 11:
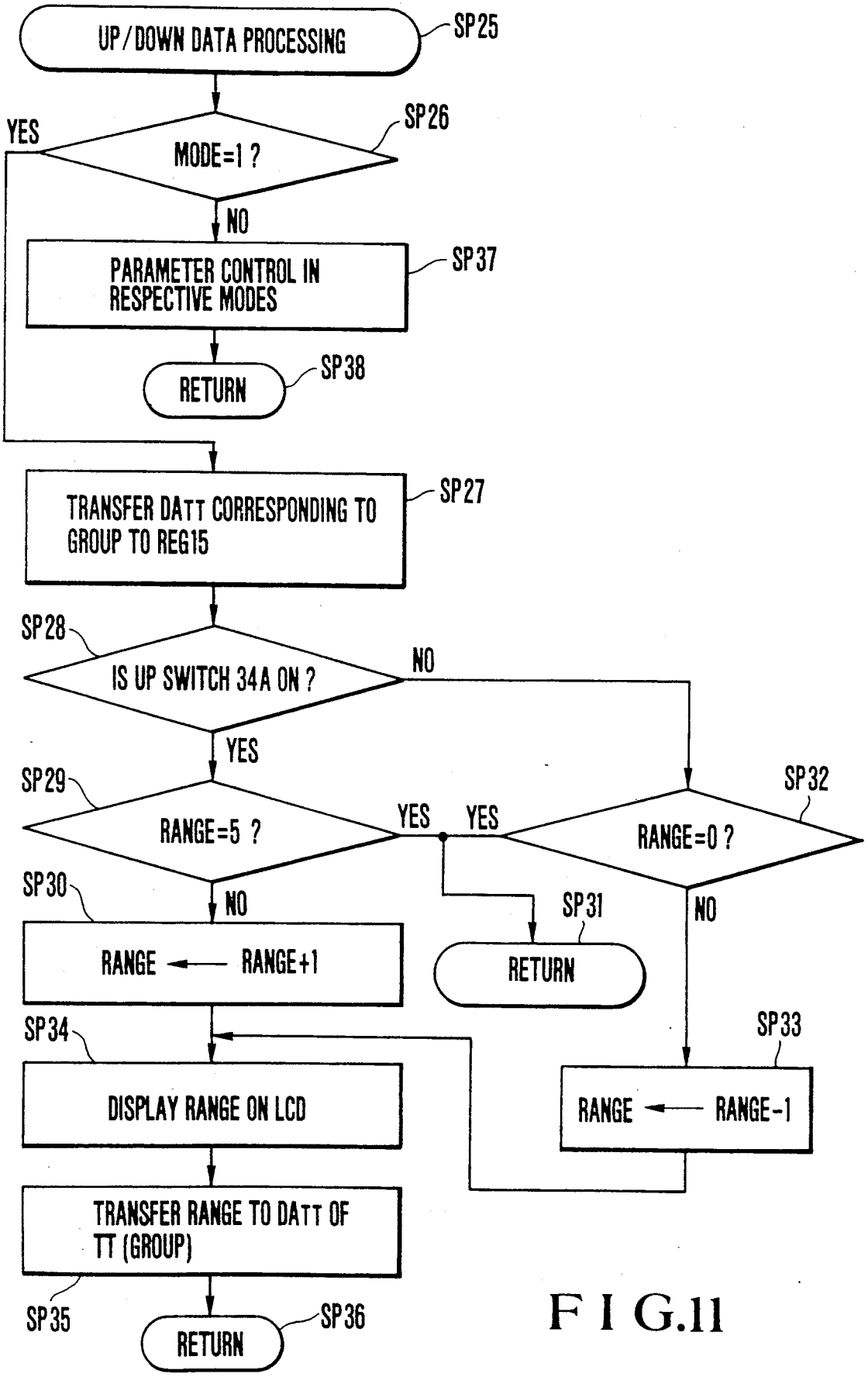

In step SP21, the up/down switch 34 (34A and 34B) of the multi-menu setting unit 16 is scanned and when an on-event of this switch occurs, the parameter displayed on the display 33 is subjected to increase/decrease processing. When the CPU 6 detects the on-event of the up/down switch 34, the flow enters a subroutine for executing the up/down data processing shown in FIG. 11. It is checked in step SP26 if the mode data MODE in the mode register REG14 represents "mode number 1".

If YES in step SP26 (i.e., if the setting mode of the touch sensitivity data RANGE(GROUP) (see step SP16) is detected), the flow advances to step SP27, and the CPU 6 selects the touch tone data TT corresponding to the tone group indicated by the tone group data GROUP stored in the tone group register REG13 from the touch tone data memory MTT of the current-value register REG11. The CPU 6 then writes the touch sensitivity data $DA_{TT}$ written in the lower 3 bits of the selected data in the touch sensitivity register REG15 as the touch sensitivity data RANGE. In this manner, the increase/decrease processing of the data RANGE written in the touch sensitivity register REG15 is allowed.

Subsequently, the flow advances to step SP28, and the CPU 6 checks if the on-event of the up/down switch 34 corresponds to that of the up switch 34A. If YES in step SP28, it is checked in step SP29 if the touch sensitivity data RANGE in the touch sensitivity register REG15 represents the maximum sensitivity level (RANGE5). If NO in step SP29, the CPU 6 adds "+1" to the touch sensitivity data RANGE of the touch sensitivity register REG15, and rewrites the updated data in the register REG15.

In this embodiment, the possible touch sensitivity ranges are 6 steps of RANGE0 to RANGE5 (FIG. 8). Therefore, the touch sensitivity range can be updated unless the touch sensitivity data RANGE reaches the maximum range RANGE5.

If YES in step SP29, the CPU 6 cannot respond to the on-event of the up switch 34A since the touch sensitivity data RANGE has already reached the maximum range RANGE5. Therefore, the CPU 6 ends the up/down processing program in step SP31, and the flow returns to the main routine.

If NO in step SP28, the CPU 6 discriminates that the on-event corresponds to the down switch 34B, and the flow advances to step SP32 to check if the content of the touch sensitivity data RANGE in the touch sensitivity register REG15 corresponds to RANGE0. If NO in step SP32, the flow advances to step SP33, and "−1" is subtracted from the data RANGE. However, if YES in step SP32, the CPU 6 ends the processing program in step SP31, and the flow returns to the main routine.

In this manner, the CPU 6 increases or decreases the touch sensitivity data RANGE in the touch sensitivity register REG15 by one range in accordance with the on-event of the up or down switch 34A or 34B by the performer.

Thereafter, the flow advances to step SP34, and the CPU 6 transfers the updated touch sensitivity data RANGE in the touch sensitivity register REG15 to the display 33 so as to display it, thereby indicating this to the performer. In step SP35, the CPU 6 writes, as the touch sensitivity data $DA_{TT}$, the updated touch sensitivity data RANGE in the lower 3 bits of the touch tone data TT(GROUP), which corresponds to the tone group indicated by the tone group data GROUP, of the touch tone data $TT_{UO}$ to $TT_{LS}$ in the touch tone data memory MTT, thereby updating the touch tone data TT(GROUP).

The CPU 6 then ends the processing program in step SP36, and the flow returns to the main routine.

The data processing in steps SP25 to SP36 has been described with reference to the case wherein the data processing procedures executed by the CPU 6 when the up/down switches 34A and 34B are operated while the touch tone switch data processing (FIG. 10) is performed and the mode data MODE represents "mode number 1". When the mode data MODE represents "mode number 2", "mode number 3", . . . , NO is obtained in step SP26. Therefore, the flow advances to step SP37, and the CPU 6 can perform increase/decrease control of the parameter value in correspondence with the mode number indicated by the mode data MODE, as described above. When the parameter setting processing procedures are completed in step SP38, the CPU 6 returns to the main routine.

The CPU 6 can rewrite the parameter data written in the other data memory MOT of the current-value register REG11 when the performer turns on the mode selection switches 31A, 31B, 31C, . . . .

DISPLAY PROCESSING OF OPERATION MEMBER ASSOCIATED WITH MULTI-MENU

Figure 12:
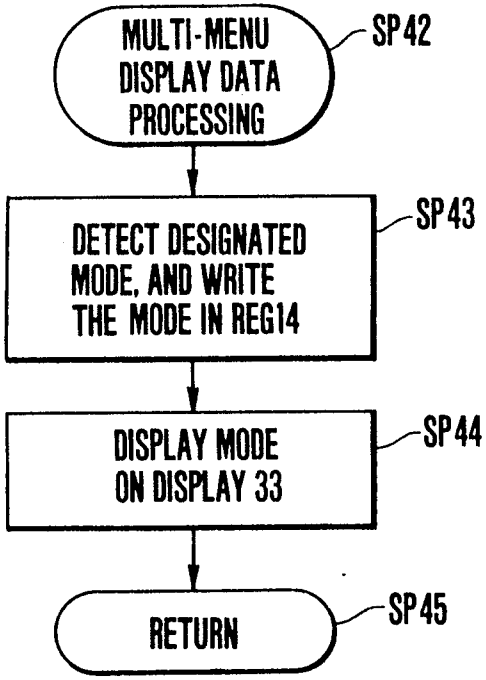

The CPU 6 executes display processing of the operation members associated with the multi-menu in step SP41 of the main routine. In step SP41, the mode selection switches 31A, 31B, 31C, . . . are scanned. When an on-event of any one of these switches is detected, a parameter corresponding to the mode selection switch corresponding to the on-event is displayed on the display 33. When the CPU 6 detects the on-event of any one of the mode selection switches 31A, 31B, 31C, . . . , control enters a multi-menu display data processing subroutine in step SP42, as shown in FIG. 12, and the CPU 6 produces mode data MODE corresponding to the mode selection switch of the on-event and writes it in the mode register REG14 of the register unit 7. Thereafter, the CPU 6 reads out the corresponding parameter from the memory MOT of the register unit 7 using the mode data MODE written in the mode register REG14, and displays the readout data on the display 33 in step SP44.

The CPU 6 displays the parameter corresponding to the selected mode in response to the mode selection of the performer. The CPU 6 then ends the program in step SP45, and the flow returns to the main routine.

PROCESSING OF PRESET SWITCH DATA

Figure 13:
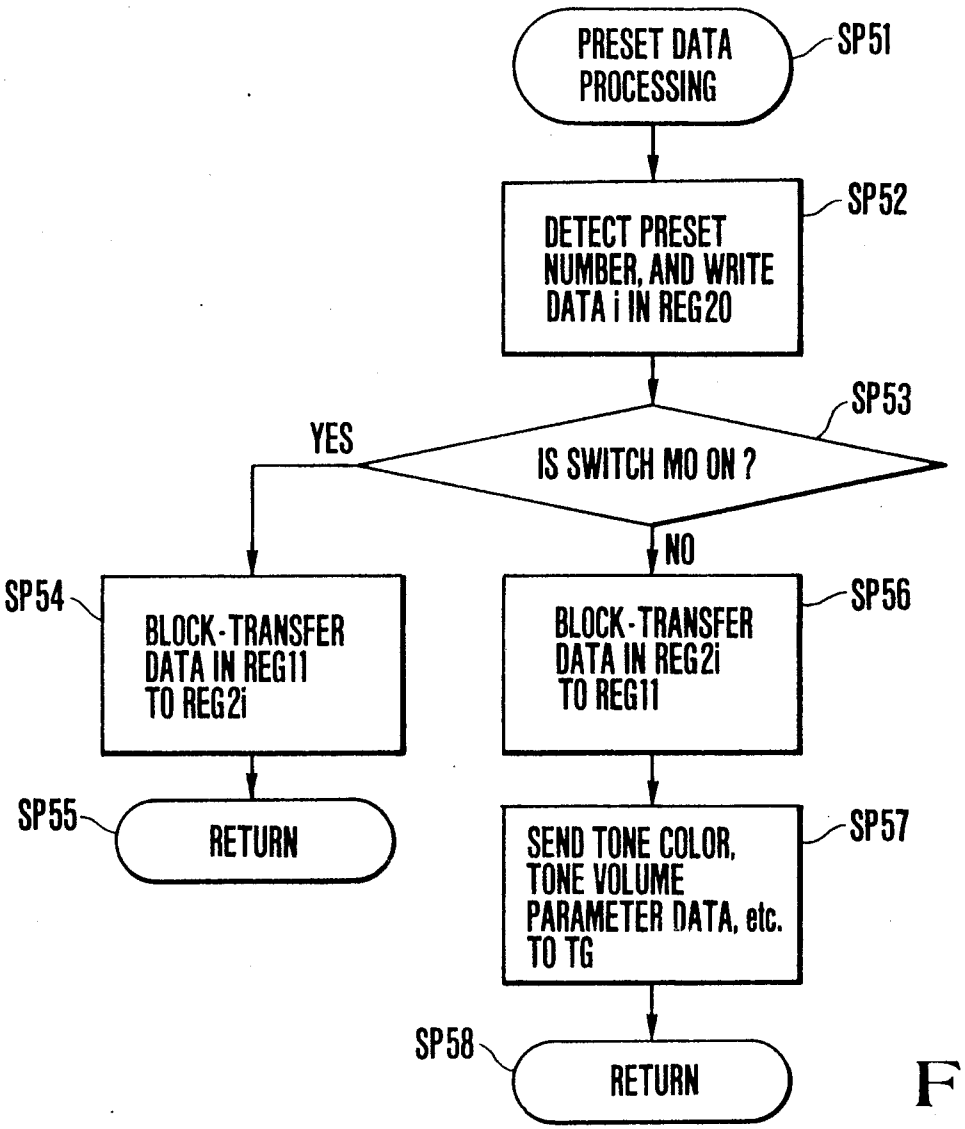

The CPU 6 executes the processing program of the preset switch data in step SP50 of the main routine. In step SP50, the performer uses the preset unit 17 so as to selectively transfer the data in the current-value register REG11 (FIG. 5) to the preset registers REG21 to REG28 (FIG. 6). The CPU 6 executes preset data processing steps shown in FIG. 13.

The CPU 6 scans the preset switches PR1 to PR8. When the CPU 6 detects an on-event of any one of these switches, control enters a preset data processing subroutine in step SP51. The CPU 6 then detects a preset data number (to be referred to as a preset number) i designated by the preset switch, corresponding to the on-event, of the preset switches PR1 to PR8, and writes the detected data i in the preset number register REG20. The flow then advances to step SP53.

It is checked in step SP53 if the write switch M0 is turned on. If YES in step SP53, the flow advances to step SP54, and all the data written in the current-value register REG11 is simultaneously block-transferred to an ith preset register REG2i.

When the performer turns on one of the preset switches PR1 to PR3 and also turns on the write switch M0 at the same time, the data in the current-value register REG11 is block-transferred to the preset register REG2i corresponding to the number of the preset switch, and processing for storing ith preset data is executed. Thereafter, the processing program is ended in step SP55, and the flow returns to the main routine.

However, if it is detected in step SP53 that the write switch M0 is not turned on, the flow advances from step SP53 to step SP56, and the CPU 6 block-transfers the data in the preset register REG2i to the current-value register REG11. Subsequently, in step SP57, the CPU 6 transfers the tone color data $TC_{UO}$ to $TC_{LS}$, the tone volume data $TV_{UO}$ to $TV_{LS}$, and the like, to the musical tone signal generator 8 as the parameter data PRD. The CPU 6 ends the processing program in step SP58, and the flow returns to the main routine.

As a result, when both the preset switch PRi and the write switch M0 are turned on, the CPU 6 executes data processing for storing the data in the current-value register REG11 set by the performer in the preset register REG2i. On the contrary, when the write switch M0 is not turned on, the CPU 6 reads out data stored in the preset register REG2i, and transfers the readout data to the current-value register REG11. Thereafter, the CPU 6 also transfers the readout data to the musical tone signal generator 8.

PROCESSING OF OTHER OPERATION MEMBER DATA

The CPU 6 executes data processing associated with the switches 36A, 36B, 36C, . . . , and the master control 37 of the other operation member group 18 in step SP59 of the main routine. In step SP59, the switches 36A, 36B, 36C, . . . , and the multi-step switch of the master control 37 are scanned, and corresponding data in the memory MOT (FIG. 5) is rewritten in accordance with the operating state of these switches. Thereafter, the rewritten data is transferred to the musical tone signal generator 8 and other circuits (automatic rhythm performance apparatus, and the like) as the parameter data PRD.

PROCESSING OF KEY DATA (INITIAL TOUCH RESPONSE

Figure 14:
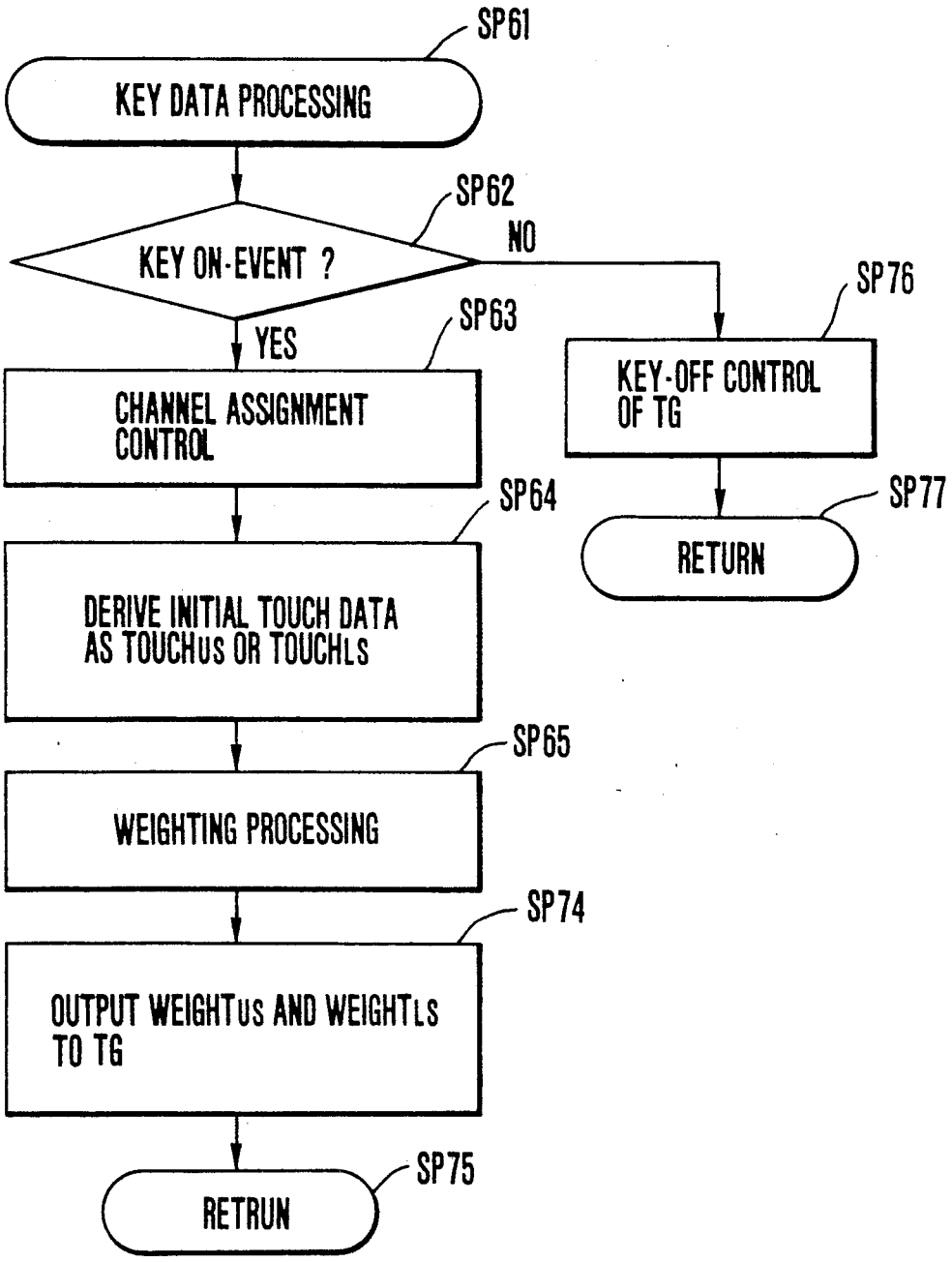

The CPU 6 executes the processing program of the key data in step SP60 of the main routine. In step SP60, the key switches of the upper and lower keyboard circuits 2U and 2L are sequentially scanned to detect key depression (on-event) and key release (off-event) of the respective key switches. Each time an event of a key is detected, the key data processing is performed for the corresponding key. More specifically, when an event of a key is detected, control enters a key data processing subroutine in step SP61 in FIG. 14. It is checked in step SP62 if the event of the corresponding key is the on- or off-event. If YES (on-event is detected) in step SP62, the flow advances to step SP63, and the CPU 6 executes channel assignment processing for assigning the key corresponding to the on-event to a vacant channel.

In this embodiment, the musical tone signal generator 8 has a predetermined number of tone generation channels for the upper and lower keyboards in a time-divisional manner. When a plurality of keys are simultaneously depressed, musical tone signals corresponding to the keys are produced using the channels. Therefore, in step SP63, if a key corresponding to the on-event belongs to the upper keyboard, the corresponding key is assigned to a vacant channel of the upper-keyboard tone generation channels. Meanwhile, if a key corresponding to the on-event belongs to the lower keyboard, the corresponding key is assigned to a vacant channel of the lower-keyboard ton generation channels. Upon key assignment, a key code indicating the key, a key-on signal (logic "1"), and channel data indicating a channel to be assigned are sent to the musical tone signal generator 8 as key data KD.

The flow advances to step SP64, and the CPU 6 derives initial touch data INT indicating a key-depression speed, which is output from the touch detector 11 for the key corresponding to the on-event. If the key belongs to the upper keyboard, the CPU 6 writes the data INT in the touch register REG17 as touch data $TOUCH_{US}$. If the key belongs to the lower keyboard, the CPU 6 writes the data INT in the register REG17 as touch data $TOUCH_{LS}$.

Subsequently, the flow advances to step SP65, and the CPU 6 executes a weighting processing program shown in FIG. 15. More specifically, the CPU 6 enters the weighting processing subroutine in step SP66, and detects a tone group to which a key corresponding to the on-event belongs, in step SP67. The CPU 6 writes the detected tone group data GROUP in the tone group register REG13. In this case, the initial touch response control is allowed only for the special tone groups (US and LS) of the upper and lower keyboards, as described above. Therefore, in tone group detection in step SP67, if a key corresponding to the on-event belongs to the upper keyboard, the tone group is detected as the upper-keyboard special tone group (US). On the other hand, if the key belongs to the lower keyboard, the tone group is detected as the lower-keyboard special tone group (LS).

In step SP68, the CPU 6 reads out touch tone data TT(GROUP) from the touch tone data memory MTT (FIG. 5) in accordance with the tone group data GROUP. It is then checked in step SP69 if the flag data $FG_{TT}$ of the touch tone data TT(GROUP) is at logic "1".

Step SP69 is a step for discriminating whether or not the mode using the touch sensitivity data set by the performer himself is set (whether the performer-set performance mode or the factory-set performance mode is selected). If YES in step SP69, the flow advances to step SP70, and the touch sensitivity data $DA_{TT}$ in the lower 3 bits of the touch tone data (GROUP) is transferred to the touch sensitivity register REG15 and is written therein as the touch sensitivity data RANGE.

However, if NO in step SP69, the flow advances to step SP78, and the CPU 6 reads out the factory-set touch sensitivity data FIXTT corresponding to tone color data TC(GROUP) of the tone group stored in the tone color memory MTC (FIG. 5) from the factory-set data memory MEM2 (FIG. 2), and transfers the readout data to the touch sensitivity register REG15. Thereafter, the flow advances to step SP71.

In step SP71, the CPU 6 reads out, from the weighting conversion table memory MEM3 (FIG. 2), the corresponding weighted touch data WEIGHT based on the data RANGE in the touch sensitivity register REG15 and touch data TOUCH corresponding to the tone group data GROUP in the touch register REG17 (in this case, either of $TOUCH_{US}$ or $TOUCH_{LS}$ since the initial touch response processing is performed). In step SP71, as described above with reference to FIG. 8, a changing ratio of weighted touch data WEIGHT with respect to a change in touch data TOUCH can be selected using the touch sensitivity data RANGE a parameter. In this way, weighted touch data WEIGHT corresponding to the touch sensitivities (RANGE0 to RANGE5) designated for the respective tone groups can be produced.

The weighted touch data WEIGHT is transferred to the weighting touch register REG18 as weighted touch data WEIGHT(GROUP) (in this case, $WEIGHT_{US}$ or $WEIGHT_{LS}$) in correspondence with the tone group data GROUP, in step SP72. The CPU 6 then ends the processing program in step SP73, and the flow returns to the key data processing subroutine shown in FIG. 14.

The CPU 6 reads out weighted touch data WEIGHT(GROUP) (in this case, $WEIGHT_{US}$ or $WEIGHT_{LS}$) corresponding to the tone group data GROUP from the weighting touch register REG18, and outputs it to the musical tone signal generator 8. Thereafter, the CPU 6 ends the key data processing program in step SP75, and the flow returns to the main routine shown in FIG. 9.

Each time a new key of the keyboard unit 2 is operated, initial touch data corresponding to the depression speed of this key is converted in accordance with a touch sensitivity designated for each tone group, and the converted initial touch response data can be sent to the musical tone signal generator 8.

In the key data processing, if the event of the key corresponds to the off-event, the flow advances from step SP62 to step SP76. In step SP76, the tone generation channel to which the key of the off-event is assigned is detected, and channel data indicating the channel and a key-off signal are sent to the musical tone signal generator 8. In the corresponding tone generation channel of the musical tone signal generator 8, a musical tone signal is controlled to obtain a decay state after the key is released.

PROCESSING OF KEY DATA (AFTER-TOUCH RESPONSE)

Figure 16:
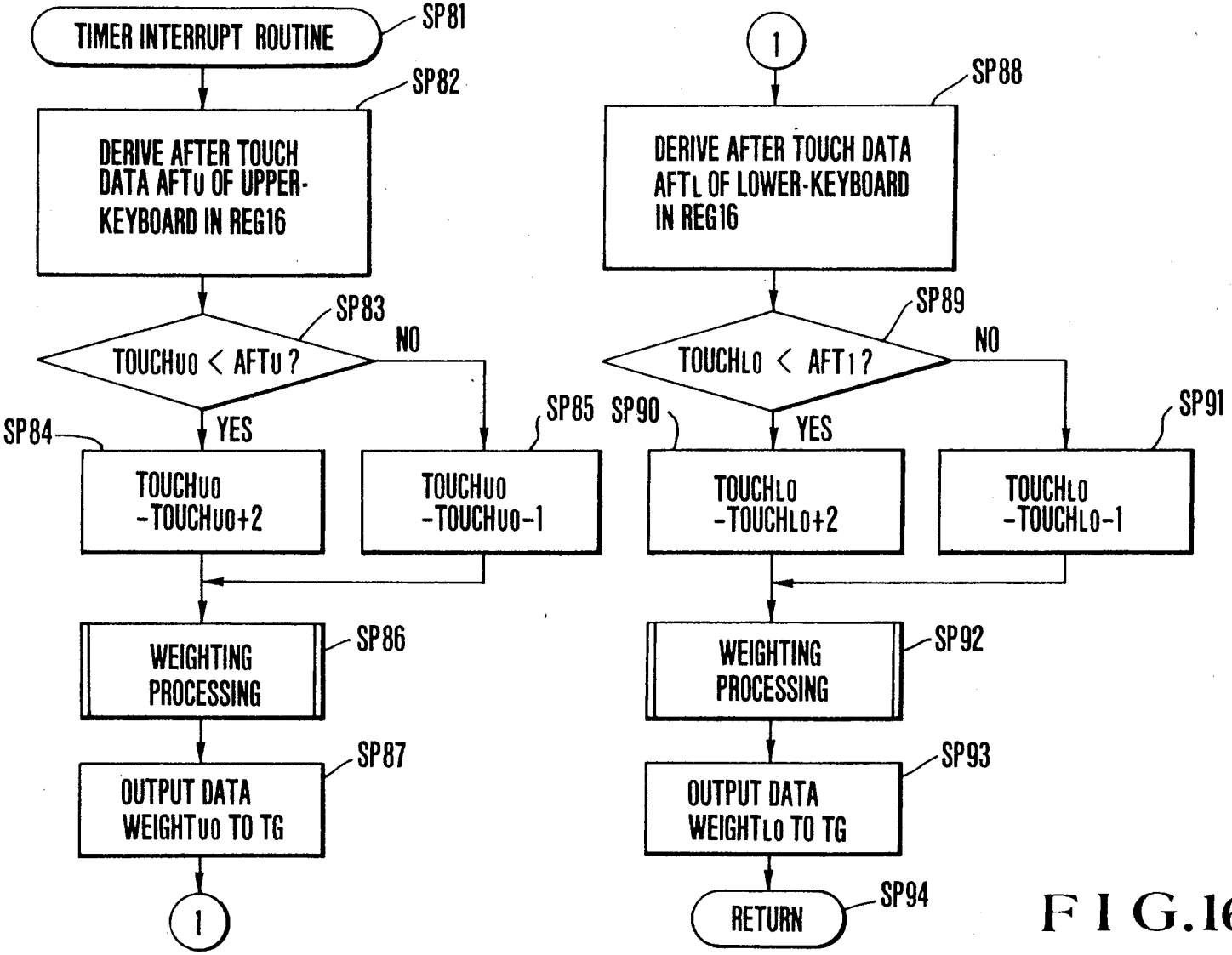

In this embodiment, after-touch response data processing is executed by a timer interrupt routine shown in FIG. 16.

An external timer 12 (FIG. 1) is connected to the CPU 6, and an interrupt signal is produced from the timer 12 in a predetermined cycle. When the CPU 6 receives the interrupt signal, control enters the timer interrupt processing subroutine in step SP81. In step SP82, after-touch data $AFT_U$ for the upper keyboard, which is detected by the touch detector 11, is stored in the after-touch register REG16. Thereafter, the flow advances to step SP83. It is checked in step SP83 if the after-touch data $AFT_U$ at the time of interruption (i.e., a current key depression force on the upper keyboard) is larger than touch data $TOUCH_{UO}$, which is associated with the upper-keyboard orchestra tone group (UO), written in the touch register REG17. If YES in step SP83, the flow advances to step SP84, and increment data "+2" is added to the touch data $TOUCH_{UO}$ written in the touch register REG17, and the sum data is rewritten in the register REG17. In this manner, the touch data $TOUCH_{US}$ is increased to follow an increase in after-touch data $AFT_U$.

If NO in step SP83, the flow advances to step SP85, and the CPU 6 subtracts decrement data "−1" from the touch data $TOUCH_{UO}$, thereby rewriting the content of the register REG17. In this manner, the touch data $TOUCH_{UO}$ is decreased to follow a decrease in after-touch data $AFT_U$.

Figure 17:
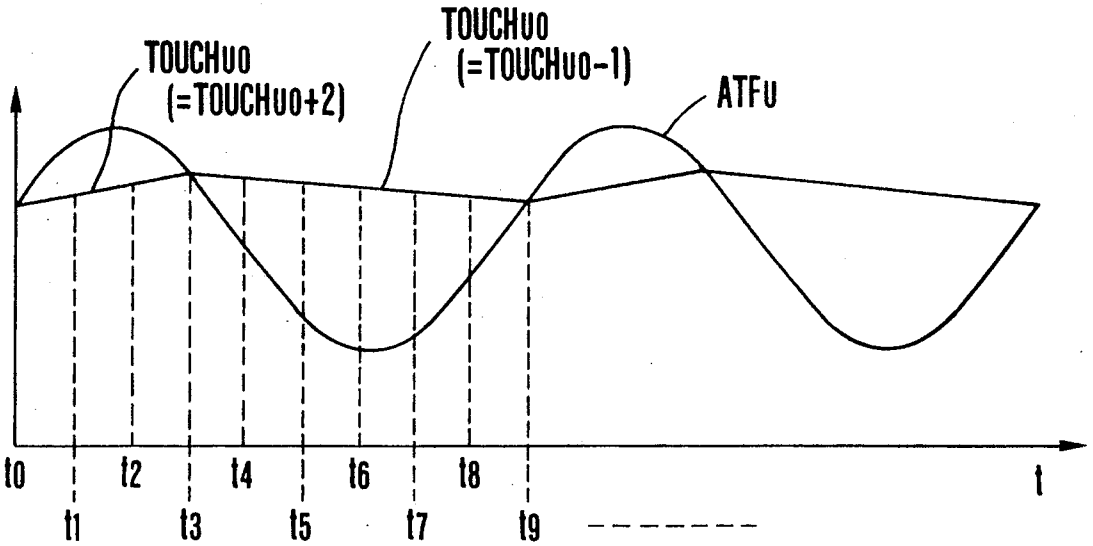
FIG. 17 is a graph for explaining timer interruption processing shown in FIG. 16.

In this case, increment and decrement data in steps SP84 and SP85 have the different values for the following reason. More specifically, as shown in FIG. 17, when the after-touch data $AFT_U$ varies upon operation of the performer, if the after-touch data $AFT_U$ is larger than the touch data $TOUCH_{UO}$, this means that the performer is increasing a key depression force. Conversely, if the after-touch data $AFT_U$ is smaller than the touch data $TOUCH_{UO}$, this means that the performer is decreasing the key depression force.

In terms of the sensitivity of the finger tip of the performer, the force of the finger tip can be relatively accurately controlled when the depression force is to be increased. However, when the depression force is to be decreased, the force of the finger tip cannot be accurately controlled. In consideration of this respect, in this embodiment, when the performer weakens the depression force, the response time is increased so as not to follow an unnecessary operation.

After this response operation, the CPU 6 executes weighting processing in step SP86. In the weighting processing, the weighting processing subroutine described with reference to FIG. 15 is repetitively executed. In this manner, after the CPU 6 executes the processing procedures in steps SP66 to SP73 in FIG. 15, the flow advances to step 87, and the weighted touch data $WEIGHT_{UO}$ is output to the musical tone signal generator 8. In this manner, after-touch response control for musical tone signals of the upper-keyboard orchestra tone group (UO) can be attained.

In steps SP88 to SP93, the CPU 6 executes the same processing as in steps SP82 to SP87 for the lower keyboard. The after-touch response control for musical tone signals of the lower-keyboard orchestra tone group (LO) can also be attained.

The CPU 6 ends the timer interrupt processing routine in step SP94, and the flow returns to the main routine.

PERFORMANCE USING FACTORY-SET TOUCH SENSITIVITY DATA

When the power source is turned on in the main routine shown in FIG. 9, the CPU 6 initializes the electronic musical instrument 1 as a whole. Thereafter, when the switches and the controls on the panel operation unit 3 are operated, the CPU 6 executes the corresponding data processing by means of the control loop of steps SP3–SP4–SP5–SP21–SP41–SP50–SP59–SP60–SP3, thereby forming the parameter data PRD of a musical tone to be generated.

If none of the touch tone switches 24A to 24D and the preset switches PR1 to PR8 are operated, the flag data $FG_{TT}$ of the touch tone data $TT_{UO}$ to $TT_{LS}$ in the current-value register REG11 is set at logic "0". Therefore, upon execution of the key data processing in step SP60, the CPU 6 reads out the touch sensitivity data FIXTT which is set in the factory from the factory-set data memory MEM2 (FIG. 2), thereby outputting the weighted touch data WEIGHT in step SP74 (FIG. 14), or in step SP87 or step SP93 (FIG. 16). The sound system 9 generates a special or orchestra musical tone to which the predetermined initial touch response or after-touch response effect is provided on the basis of the factory-set touch sensitivity data FIXTT corresponding to a tone color for each tone group.

PERFORMANCE USING PERFORMER-SET TOUCH SENSITIVITY DATA

When the performer performs a musical piece using touch sensitivity data which he has set, he selectively operates the touch tone designating switches 24A to 24D for each tone group, thereby designating the performer-set performance mode. In this case, when the up/down switch 34 of the multi-menu setting unit 16 is operated, the touch sensitivity data which is already set by the performer can be set.

The CPU causes the display 33 to display tone group data GROUP indicating a tone group corresponding to the operated one of the touch tone designating switches 24A to 24D and touch sensitivity data RANGE based on the touch sensitivity data $DA_{TT}$ of the corresponding tone group written in the current-value register REG11 (step SP18) in the subroutine (FIG. 10) in touch tone data processing step SP5.

In the up/down data processing subroutine (FIG. 11) corresponding to step SP21 (FIG. 9) of the main routine, the touch sensitivity data RANGE is incremented or decremented upon operation of the up/down switch 34 of the performer (steps SP30 and step SP33), and the updated data is written in the current-value register REG11 (step SP35).

The touch tone sensitivity data $DA_{TT}$ written in the touch tone data memory MTT of the current-value register REG11 upon operation by the performer is used in weighting processing step SP66 in the subroutine (FIG. 14) each time the performer operates a key.

More specifically, in step SP69 of the weighting processing subroutine (FIG. 15), the CPU 6 determines that the performer-set performance mode is selected, and executes the weighting processing based on the touch sensitivity data $DA_{TT}$ in the current-value register REG11 in steps SP70 and SP71. As a result, upon key operation by the performer, the upper- and lower-keyboard special tone groups generate musical tones, to which the initial response effect is provided at the touch sensitivity based on the touch sensitivity data which is input by the performer, are produced.

Figure 15:
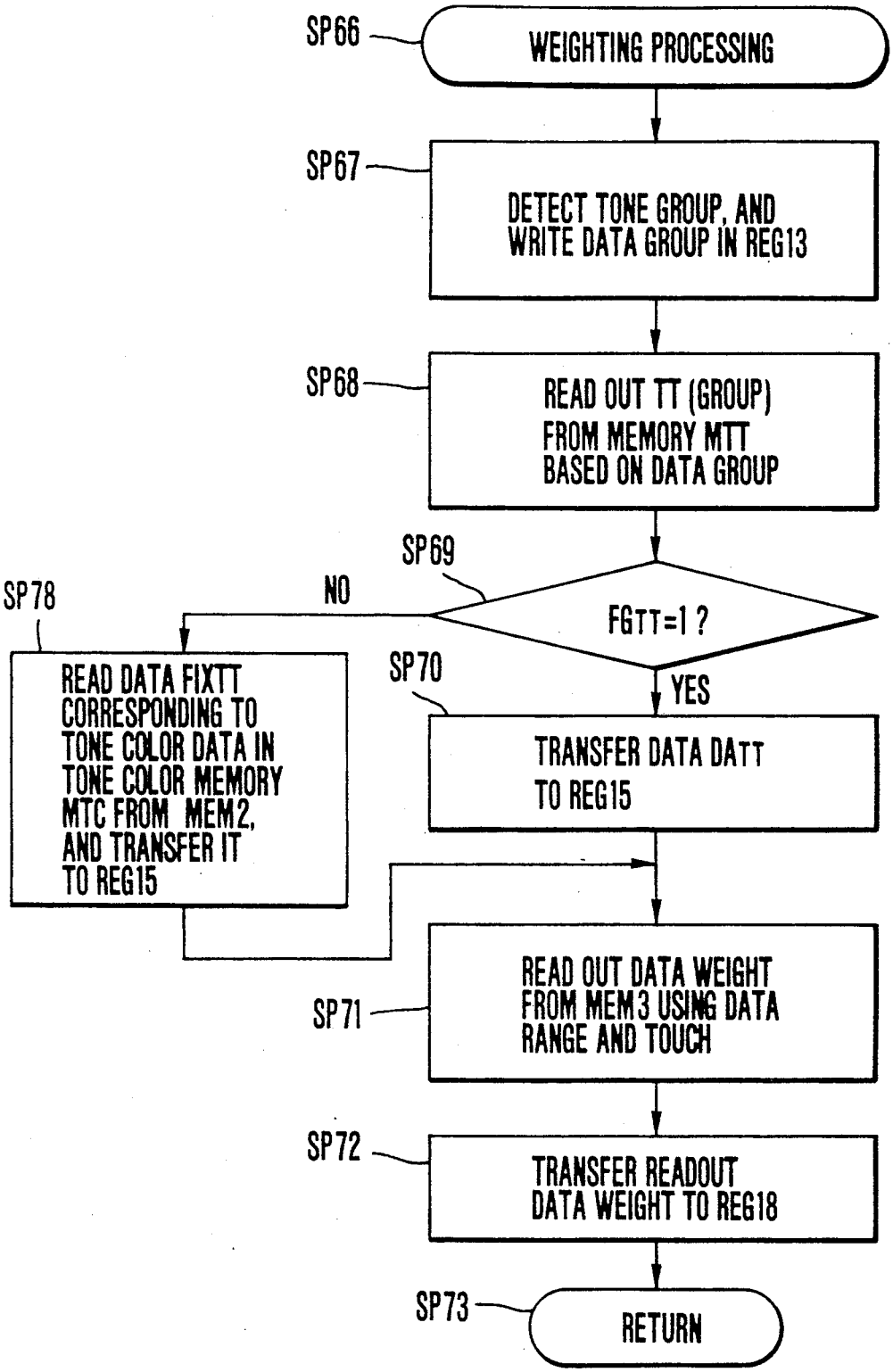

In weighting processing steps SP86 and SP92 in the timer interrupt subroutine (FIG. 16), the weighting processing shown in FIG. 15 is similarly used. Thus, the upper- and lower-keyboard orchestra tone groups generate musical tones, to which the after-touch response effect is provided at the touch sensitivity based on the touch sensitivity data which is input by the performer, are produced.

PERFORMANCE USING DATA PRESET BY PERFORMER

The performer can preset a maximum of eight sets of performance parameters in the preset registers REG21 to REG28. When the preset data is read out to the current-value register REG11 as needed, performance using the touch sensitivity data that is input by the performer can be carried out in the same manner as described above.

When the performer wants to preset data, he turns on the write switch M0 of the preset unit 23, and operates one of the preset switches PR1 to PR8. At this time, the CPU 6 executes the preset switch data processing program in step SP50 of the main routine (FIG. 9). More specifically, in the subroutine shown in FIG. 13, the CPU 6 writes the number data i of the operated preset switch in the corresponding preset number register REG20 in step SP52. The CPU 6 detects in step SP53 that the write switch M0 is operated. The CPU 6 simultaneously block-transfers the data in the current-value register REG11 to the ith preset register REG2i, and stores it therein in step SP54.

In order to read out data preset in the preset register REG2i later, the write switch M0 need only be turned off. At this time, the CPU 6 detects this in step SP53 in the subroutine shown in FIG. 13, and simultaneously block-transfers the data in the ith preset register REG2i to the current-value register REG11 in step SP56.

Musical tones can thus be generated based on the preset parameter data transferred to the current-value register REG11. In this case, musical tones to which the initial touch response or after-touch response effect is provided using the preset touch sensitivity data can be generated.

According to the above embodiment, the first to fourth tone group setting sections 21A to 21D are provided for four tone groups, and touch sensitivity data can be input for each tone group. When the performer performs a musical piece with the initial touch response or after-touch response effect, he can set a desirable strength of the touch response for each tone group. Therefore, rich performance expression can be made as compared to a conventional electronic musical instrument which is factory-set.

Since the touch sensitivity data can be input for each tone group, there is no fear of a complicated input operation for inputting the touch sensitivity data.

According to the above embodiment, a plurality of sets (i.e., eight sets) of touch sensitivity data can be preset. If a plurality of touch sensitivities are preset before performance, the touch sensitivity can be easily set at a desired value only by operating the preset switches PR1 to PR8 without resetting the touch sensitivity.

In the above embodiment, tone groups are classified into the orchestra tone (sustain tone) group and the special tone (decay tone) group with reference to the waveform of an amplitude envelope of a musical tone. Instead, the tone groups can be classified in units of tone colors. Thus, tones need only be classified in units of generation systems of musical tone signals.

In the above embodiment, touch data which is weighted by the touch sensitivity is transferred to the musical tone generator 8 so as to control a tone volume of a musical tone. Alternatively, if other musical tone parameters, e.g., a tone color, pitch, vibrato speed, vibrato depth, and the like are controlled using the weighted touch data, the same effect as described above can be obtained.

In the above embodiment as a tone color control method, two series of waveform signals are generated for each tone group, and a mixing ratio of the two series of waveform signals is updated in accordance with the touch data, so that the tone color of the mixed waveform signals can be controlled, as disclosed in U.S. Pat. No. 4,138,915.

When the tone color selection switches 22A to 22D are selectively operated, the touch sensitivity data can be displayed on the display 33 in accordance with the operating state of the touch tone designating switches 24A to 24D. For example, when the touch tone designating switch is turned on (in the case of the performer-set performance mode), the touch sensitivity data in the current-value register REG11 can be displayed. On the contrary, when the touch tone designating switches 24A to 24D are turned off (in the case of the factory-set performance mode), the factory-set touch sensitivity data corresponding to a tone color of the corresponding tone color selection switch stored in the factory-set data memory MEM2 can be displayed.

In the above embodiment, the touch sensitivity can be selected for both the initial touch response and the after-touch response. Instead, the touch sensitivity can be set for one of these responses.

In the above embodiment, either of the initial touch response or the after-touch response can be provided to one tone group. However, both the initial touch response and the after-touch response can be provided to each single tone group. In this case, the touch sensitivity ca be set commonly to the initial touch response and the after-touch response, or can be individually set.

In the above embodiment, when the weighted touch data WEIGHT is obtained, a conversion means using the weighting conversion table memory MEM3 is used. Instead, the weighted touch data WEIGHT can be obtained by an arithmetic operation using an arithmetic operation circuit. In this case, the same effect as described above can also be obtained.

In the above embodiment, when the weighted touch data WEIGHT is obtained from the touch data TOUCH (FIG. 8), conversion functions (RANGE0 to RANGE5) having six types of changing rates are preset, and one of these functions is selected in accordance with the touch sensitivity data. Alternatively, the touch sensitivity data can directly represent a coefficient (changing ratio) of the conversion functions, and the performer can desirably determine this coefficient.

In the above embodiment, four musical tone signal generation systems are adopted. The number of systems can be selected as needed. That is, the present invention can be widely applied to an electronic musical instrument having any number of musical tone signal generation systems.

In the above embodiment, the range of the touch sensitivity has not been described. As will be described in the following embodiment, the upper and lower limits of the touch sensitivity can be desirably changed.

Figure 18:
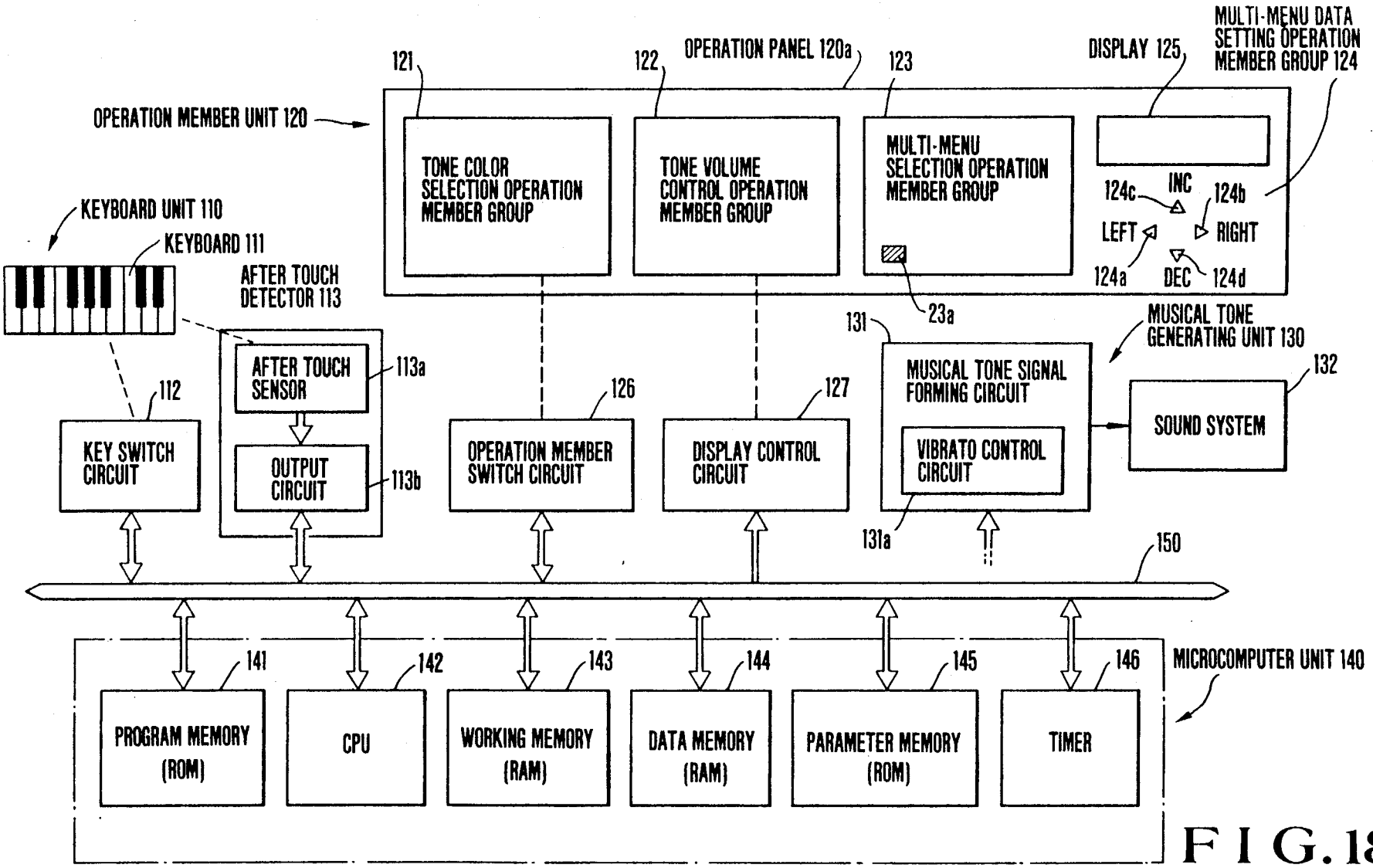
FIG. 18 is a block diagram of an electronic musical instrument according to another embodiment of the present invention.
Figure 19:
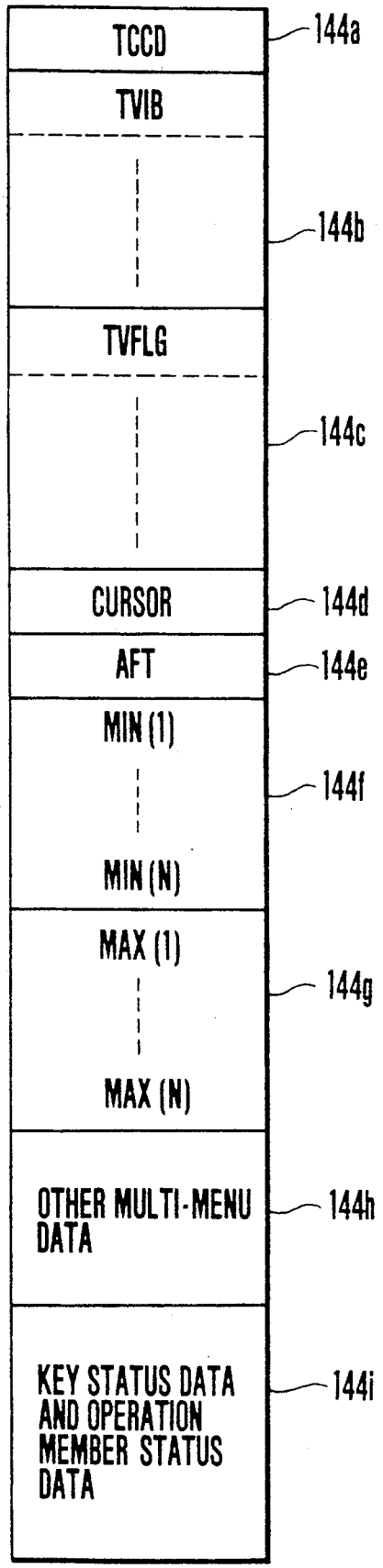
FIG. 19 is a memory map of a data memory 144 shown in FIG. 18.

Another embodiment of the present invention will be described hereinafter with reference to FIGS. 18 to 33. FIG. 18 schematically shows an electronic musical instrument according to this embodiment. The electronic musical instrument comprises a keyboard unit 110 for designating a tone pitch of a musical tone to be generated, an operation member unit 120 for controlling the state of a musical tone to be generated, a musical tone generator 130 for generating musical tones, and a microcomputer unit 140 for controlling the generating state of musical tones in the musical tone generator 130 in accordance with the operating states of the keyboard unit 110 and the operation member unit 120. The keyboard unit 110, the operation member unit 120, the musical tone generator 130 and the microcomputer unit 140 are connected to a bus 150.

The keyboard unit 110 has a keyboard 111 consisting of a plurality of keys corresponding to tone pitches of musical tones to be generated, a key switch circuit 112 for detecting key-on (key depression) operations on the keyboard 111, and an after-touch detector 113 for detecting a key touch upon each the key-on operations on the keyboard 111. The key switch circuit 112 consists of a plurality of key switches corresponding to the keys of the keyboard 111. Each key switch supplies key state data representing an on/off state of each key to the microcomputer unit 140 through the bus 150 in response to a key on/off detection control signal which is supplied from the microcomputer unit 140 also through the bus 150. The after-touch detector 113 comprises an after-touch sensor **113*a* which is arranged commonly to the respective keys of the keyboard 111, and an output circuit 113*b* for outputting the output from the sensor 113*a* to the microcomputer unit 140. The after-touch sensor 113*a* detects a maximum key depression depth or a maximum key depression force of key depression depths or key depression forces upon key depression of the keys of the keyboard 111, and supplies, to the output circuit 113*b*, after-touch data AFT representing one of values "0" to "63" proportional to the maximum key depression depth or the maximum key depression force. The output circuit 113*b* supplies the after-touch data to the microcomputer unit 140 through the bus 150 in response to a touch data fetch control signal which is supplied from the microcomputer unit 140 through the bus 150**.

The operation member unit 120 comprises a tone color selection operation member group 121, a tone volume control operation member group 122, a multi-menu selection operation member group 123, a multi-menu data setting operation member group 124, a display 125, an operation member switch circuit 126, and a display control circuit 127. The tone color selection operation member group 121 has a plurality of tone color selection switches for selecting tone colors, such as violin, flute, and the like. The tone volume control operation member group 125 has a plurality of operation members for selecting and controlling the tone volume of musical tones and the types of rhythm in an automatic rhythm apparatus. The multi-menu selection operation member group 123 has a plurality of operation members, such as a touch vibrato switch 123*a*. These operation members correspond to types of musical tone modes, controlled by data that is set by the multi-menu setting operation element group 124, so as to select the presence/absence of musical tone control. The multi-menu data setting operation member group 124 comprises operation members 124*a* and 124*b* for moving a cursor displayed on the display 125 to the right and left, and operation members 124*c* and 124*d* for controlling increase/decrease of data indicated by the cursor on the display 125. The display 125 comprises a liquid-crystal display device, and displays values of various data. The operation members of the operation member groups 121 to 123 each incorporate display elements comprising light-emitting diodes, so that the selection states of the respective operation members can be indicated by turning on or off the display elements. The operation member switch circuit 126 has a plurality of operation member switches corresponding to the operation members of the operation member groups 121 to 124. Each operation member switch supplies operation-member status data to the microcomputer unit 140 through the bus 150 in accordance with the operation member detection control signal which is supplied from the microcomputer unit 140 through the bus 150. The display control circuit 127 controls the display state of the display 125 and the ON/OFF operations of the display elements which are incorporated in the operation members of the operation member groups 121 to 123 in response to the display control data which is supplied from the microcomputer unit 140 through the bus 150.

The musical tone generator 130 comprises a musical tone signal forming circuit 131 and a sound system 132. The musical tone signal forming circuit 131 forms and outputs a musical tone signal in which a musical tone mode, such as a tone pitch, tone color, tone volume, and the like, is set in accordance with key data and musical tone control data which are supplied from the microcomputer unit 140 through the bus 150. The musical tone signal forming circuit 131 incorporates an effect providing circuit, such as a vibrato control circuit 131*a*, and the like, so that an effect such as vibrato is added to the formed musical tone signal based on effect control data such as vibrato control data which is supplied from the microcomputer unit 140 through the bus 150. The sound system 132 comprises an amplifier, a loudspeaker, and the like, and generates the musical tone signal supplied from the musical tone signal forming circuit 131 as the corresponding musical tone.

The microcomputer unit 140 comprises a program memory 141, a central processing unit (to be referred to as a CPU hereinafter) 142, a working memory 143, a data memory 144, a parameter memory 145, and a timer circuit 146. These memories 141, 143, 144, and 145, the CPU 142, and the timer circuit 146 are connected to the bus 150. The program memory 141 comprises a read-only memory (to be referred to as a ROM hereinafter), and stores programs corresponding to the flow charts shown in FIGS. 22 to 24 and FIGS. 27 to 32. The CPU 142 executes these programs, and initiates execution of the "main" program corresponding to the flow chart shown in FIG. 22 upon turning on of a power source switch (not shown). The working memory 143 comprises a random access memory (to be referred to as a RAM hereinafter), and temporarily stores variables necessary for execution of the programs. The data memory 144 comprises a RAM, and is divided into registers 144*a*, 144*d*, 144*e*, and register groups 144*b*, 144*c*, and 144*f* to 144*i*, as shown in the memory map of FIG. 19.

The register 144*a* stores tone color code data TCCD representing a tone color name which is selected by the tone color selection operation member group 121.

The register group 144*b* has a plurality of registers corresponding to the operation members (e.g., the touch vibrato switch 123*a*) of the multi-menu selection operation member group 123. Each register stores control data (e.g., touch vibrato data TVIB) which corresponds to one operation member and represents the presence/absence of musical tone mode control (e.g., touch vibrato mode), corresponding to the operation member, which is set upon selective operation of the operation members. In this case, logic "1" of the control data such as the touch vibrato data TVIB represents the "presence of control", and logic "0" of the control data represents the "absence of control".

The register group 144*c* has a plurality of registers corresponding to the register group 144*b*. Each register stores a flag (e.g., a touch vibrato flag TVFLG) which represents, for each musical tone mode, at logic "1" that a data setting operation using the multi-menu data setting operation member group 124 is enabled, and represents at logic "0" that the data setting operation using the operation member group 124 is disabled. In this case, two or more flags cannot be set at logic "1" at the same time.

The register 144*d* stores cursor position data CURSOR indicating the cursor position which is displayed on the display 125 upon operation of the operation members 124*a* and 124*b*. The cursor position data CURSOR represents a cursor left-movement position at logic "0" and represents a cursor right-movement position at logic "1".

The register 144*e* stores the after-touch data AFT which is output from the after-touch detector 113.

The register group 144*f* has a plurality of registers corresponding to the tone color selection switches of the tone color selection operation member group 121. Each register stores one of lower-limit data MIN(1) to MIN(N) which is set by the operation members 124*c* and 124*d* and represents lower-limit values of vibrato depth data VIBDEP that changes according to the after-touch data AFT. In this case, a value N indicates the number of tone color selection switches of the tone color selection operation member group 121.

The register group 144*g* has a plurality of registers corresponding to the register group 144*f*. Each register stores one of upper-limit data MAX(1) to MAX(N) which is set by the operation members 124*c* and 124*d* and represents upper-limit values of the vibrato depth data VIBDEP.

The register group 144*h* has a plurality of registers which store multi-menu data other than the upper-and lower-limit values of the vibrato depth data VIBDEP, which are set upon operation of the multi-menu data setting operation member group 124.

The register group 144*i* has a plurality of registers for storing key-status data and the operation-member status data which represent the previous operating states of the keys and the operation members, respectively.

Figure 20:
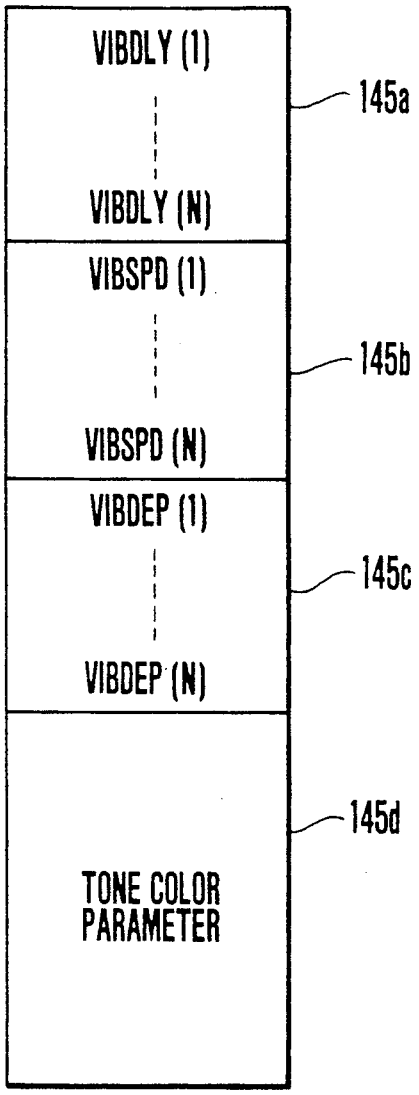
FIG. 20 is a memory map of a parameter memory 145 shown in FIG. 18.
Figure 21:
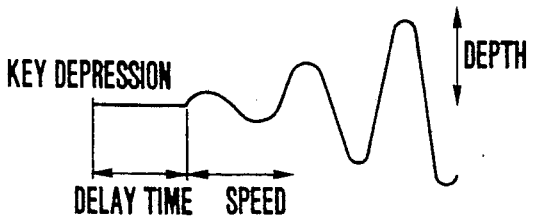
FIG. 21 is a waveform chart of a vibrato signal.

The parameter memory 45 comprises a ROM, and is divided into memory areas 145*a*, 145*b*, 145*c*, and 145*d*, as shown in the memory map in FIG. 20.

The memory area 145*a* stores vibrato delay time data VIBDLY(1) to VIBDLY(N) each representing a vibrato delay time (FIG. 21), suitable for each tone color, from a key-on operation of the keyboard 111 until a vibrato signal is generated, in correspondence with the tone color selection switches of the tone color selection operation member group 121.

The memory area 145*b* stores vibrato speed data VIBSPD(1) to VIBSPD(N) each representing a vibrato speed (FIG. 21), which is suitable for each tone color and is inversely proportional to the cycle of the vibrato signal, in correspondence with the tone color selection switches of the tone color selection operation member group 121.

The memory area 145*c* stores vibrato depth data VIBDEP(1) to VIBDEP(N) each representing a vibrato depth (FIG. 21) which is suitable for each tone color and proportional to the amplitude of the vibrato signal, in correspondence with the tone color selection switches of the tone color selection operation member group 121.

The memory area 145*d* stores a tone color parameter necessary for tone color formation of a musical tone to be generated in correspondence with the tone color selection switches of the tone color selection operation member group 121.

The timer circuit 146 measures a lapse time during execution of the program of the CPU 142 independently of the execution of the program, and generates a timer interrupt command signal to the CPU 142 each time a predetermined period of time, where a change in after touch data corresponding to an after touch causes no aural problem, has passed. Upon generation of the interrupt command signal, the CPU 142 interrupts execution of the program, and executes a "timer interrupt" program corresponding to the flow chart shown in FIG. 32.

The basic operation of the electronic musical instrument having the above arrangement will now be described with reference to the flow chart shown in FIG. 22. When the power source switch (not shown) is turned on, the execution of the main program is initiated from step 100 in FIG. 22, and initialization processing is executed in step 101. In the processing of step 101, the CPU 142 writes tone color code data TCCD indicating a standard tone color in the register 143*a*, and outputs the data TCCD to the musical tone signal forming circuit 131 through the bus 150. The musical tone signal forming circuit 131 can be set in a standby state wherein generation of a musical tone signal having the standard tone color is allowed. Even if the keyboard 111 is operated immediately after the power source switch is turned on, the electronic musical instrument can generate musical tones of the standard tone color. In the processing of step 101, the CPU 142 writes data "0" in the respective registers of the register group 144*f*, thereby initializing the lower-limit data MIN(1) to MIN(N). The CPU 142 also writes data "63" in the respective registers of the register group 144*g*, thereby initializing the upper-limit data MAX(1) to MAX(N). In addition, the CPU 142 writes data "0" in the registers of the remaining register groups 144*b*, 144*c*, 144*h*, and 144*i* and registers 144*d* and 144*e*, thereby clearing these registers.

After the processing of step 101, the CPU 142 supplies an operation member detection control signal to the operation member switch circuit 126 through the bus 150 in step 110. The CPU 142 thus derives latest operation-member status data of the tone color selection switches of the tone color selection operation member group 121. The CPU 142 then compares the derived operation-member status data with the operation-member status data representing the previous operating states of the respective operation members stored in the register group 144*i*, thereby detecting a new on-event of any one of the tone color selection operation member group 121. In this comparison processing, if a new on-event of a tone color selection switch is detected, the CPU 142 determines YES in step 110, and executes a "TONE COLOR" program corresponding to the flow chart shown in FIG. 23 (to be described later) in step 111. The CPU 142 thus updates the tone color of the musical tone to be generated from the musical tone generator 130 in accordance with the new on-event of the tone color selection switch, and also updates control data associated with vibrato upon updating of the tone color. In the comparison processing in step 110, if no new on-event of a tone color selection switch is detected, the CPU 142 determines NO in step 110, and the flow advances to step 120 without executing the "TONE COLOR" program. When a new on-event of a tone color selection switch is detected in the comparison processing of step 110, and when it is detected that the tone color selection switch which is kept on is turned off, that is, when the operating state of the tone color selection switch is altered, the CPU 142 updates the operation-member status data in the register group 144*i* associated with the tone color selection switch with the event in accordance with the derived latest operation-member status data.

After the processing of steps 110 and 111, the CPU 142 derives latest operation-member status data associated with the touch vibrato switch 123*a* from the operation member switch circuit 126, and compares the derived data with operation-member status data associated with the touch vibrato switch 123*a* stored in the register group 144*i*, thereby detecting a new on-event of the touch vibrato switch 123*a* in step 120. In this comparison processing, if a new on-event of the touch vibrato switch 123*a* is detected, the CPU 142 determines YES in step 120, and executes a "TVIB ON" program corresponding to the flow chart shown in FIG. 27 (to be described later) in step 121, thereby updating control data associated with vibrato. If no new on-event of the touch vibrato switch 123*a* is detected in the comparison processing in step 120, the CPU 142 determines NO in step 120, and the flow advances to step 130 without executing the "TVIB ON" program. In this case, if the operating state of the touch vibrato switch 123*a* is altered, the CPU 142 updates the operation-member status data in the register group 144*i* associated with the touch vibrato switch 123*a* in accordance with the derived latest operation-member status data, in the same manner as in the processing of step 110.

After the processing of steps 120 and 121, in step 130, the CPU 142 derives latest operation-member status data associated with the operation members 124*a* and 124*b* from the operation member switch circuit 126, in the same manner as in the processing of step 110. The CPU 142 then compares the derived data with the operation-member status data which is associated with the operation members 124*a* and 124*b* and is stored in the register group 144*i*, thereby detecting new on-events of the operation members 124*a* and 124*b*. If a new on-event of the operation member 124*a* is detected in this comparison processing, the CPU 142 executes a "LEFT ON" program corresponding to the flow chart shown in FIG. 28 (to be described later) in step 130, thereby moving the cursor display position on the display 125 to the left. If a new on-event of the operation member 124*b* is detected, the CPU 142 executes a "RIGHT ON" program corresponding to the flow chart shown in FIG. 29 (to be described later) in step 130, thereby moving the cursor display position on the display 125 to the right. In the comparison processing in step 130, if no new on-event of the operation members 124*a* and 124*b* is detected, the CPU 142 advances the flow to step 140 without executing the "LEFT ON" and "RIGHT ON" programs in step 130. In this case, when the operating states of the operation members 124*a* and 124*b* are altered, the CPU 142 updates the operation-member status data associated with the operation members 124*a* and 124*b* in the register group 144*i* according to the derived latest operation-member status data.

After the processing of step 130, the CPU 142 derives latest operation-member status data of the operation members 124*c* and 124*d* from the operation member switch circuit 126 in step 140, in the same manner as in the processing of step 110. The CPU 142 then compares the derived data with the operation-member status data of the operation members 124*c* and 124*d* which is stored in the register group 144*i*, thereby detecting new on-events of the operation members 124*c* and 124*d*. In this comparison processing, if a new on-event of the operation member 124*c* is detected, the CPU 142 executes an "INC ON" program corresponding to the flow chart shown in FIG. 30 (to be described later) in step 140, thereby incrementing control data (e.g., lower-limit data MIN(1) to MIN(N), upper-limit data MAX(1) to MAX(N), and the like). If a new on-event of the operation member 124*d* is detected, the CPU 142 executes a "DEC ON" program corresponding to the flow chart shown in FIG. 31 (to be described later) in step 140, thereby decrementing such control data. If no new on-event of the operation members 124*c* and 124*d* are detected in the comparison processing in step 140, the CPU 142 advances the flow to step 150 without executing the "INC ON" and "DEC ON" programs in step 140. In this case, when the operating states of the operation members 124*c* and 124*d* are altered, the CPU 142 updates the operation-member status data of the operation members 124*c* and 124*d* in the register group 144*i* in step 140 according to the derived latest operation-member status data, in the same manner as in the processing of step 110.

After the processing of step 140, the CPU 142 derives latest operation-member status data of an operation member excluding the touch vibrato switch 123*a* of the multi-menu selection operation member group 123 from the operation member switch circuit 126 in step 150, in the same manner as in the processing of step 110. The CPU 142 compares the derived data with the operation-member status data of the operation member other than the touch vibrato switch 123*a* which is stored in the register group 144*i*, thereby detecting a new on-event of the operation members other than the touch vibrato switch 123*a*. If a new on-events of the operation members other than the touch vibrato switch 123*a* of the multi-menu selection operation member group 123 is detected in this comparison processing, the CPU 142 determines YES in step 150, and inverts the flag associated with the operation member corresponding to the new on-event, which is stored in the register group 144*c* in step 151. At the same time, if the inverted flag is at logic "1", the CPU 142 sets all the remaining flags (e.g., the touch vibrato flag TVFLG, and the like) stored in the register group 144*c* at logic "0". In step 152, the CPU 142 then executes multi-menu processing associated with the operation member, such as updating and storage of control data associated with the operation member corresponding to the new on-event into the register group 144*h*, transfer of the control data to the musical tone signal forming circuit 131, and turn-on and turn-off control of the display elements incorporated in the operation members of the multi-menu selection operation member group 123. With the processing of steps 151 and 152, the type of control data which is to be set upon operation of the multi-menu data setting operation member group 124 can be updated, and the state of a musical tone signal which is formed by the musical tone signal forming circuit 131 upon operation of the operation member other than the touch vibrato switch 123*a* of the multi-menu selection operation member group 123 can be controlled. If no new on-event of the operation member other than the touch vibrato switch 123*a* of the multi-menu selection operation member group 123 is detected in the comparison processing in step 150, the CPU 142 determines NO in step 150, and the CPU 142 advances the flow to step 160 without executing the processing of steps 151 and 152. In this case, if the operating state of the operation member other than the touch vibrato switch 123*a* of the multi-menu selection operation member group 123 is altered, the CPU 142 updates the operation-member status data which corresponds to the event and is associated with the operation member other than the touch vibrato switch 123*a* in step 150, in the same manner as in the processing of step 110.

After the processing in steps 150 to 152, in step 160, the CPU 142 derives the latest operation-member status data associated with, e.g., a tone volume control operation member of the tone volume control operation member group 122 from the operation member switch circuit 126. The CPU 142 then compares the derived data with the operation-member status data associated with the corresponding operation member, which is stored in the register group 144*i*, thereby detecting a new on-event of, e.g., the tone volume control operation member. In this comparison processing, if a new on-event of the tone volume control operation member is detected, the CPU 142 determines YES in step 160, and executes related processing of the tone volume control operation member, such as transfer of control data associated with the tone volume control operation member corresponding to the new on-event, turn-on and turn-off control of the display elements incorporated in the operation members of the tone volume control operation member group 122 in accordance with the detected on-event, and the like, in step 161. The state of a musical tone signal formed by the musical tone signal forming circuit 131 can be controlled upon operation of the tone volume control operation member group 122, and this operating state is displayed by the display elements incorporated in the operation members of the group 122. In the comparison processing of step 160, if the on-event of the operation members of the tone volume control operation member group 122 cannot be detected, the CPU 142 determines NO in step 160, and advances the flow to step 170 without executing the processing of step 161. In this case, if the operating states of the operation members of the tone volume control operation member group 122 are altered, the CPU 142 updates the operation-member status data associated with the tone volume control operation member corresponding to the event, which is stored in the register group 144*i*, in accordance with the derived operation-member status data in step 160, in the same manner as in the processing of step 110.

After the processing of steps 160 and 161, the CPU 142 outputs a key on/off detection control signal to the key switch circuit 122 through the bus 150 in step 170, thereby deriving the latest key-status data of the respective keys of the keyboard 111. The CPU 142 then compares the derived data with the key-status data stored in the register group 144*i*, which represents the previous state of each key, thus detecting a key-on (or key depression) or key-off (key release) operation on the keyboard 111. In this comparison processing, if a new key-on operation on the keyboard 111 is detected, the CPU 142 supplies key data consisting of key code data that represents a key corresponding to the detected on-event and key-on data that represents the key-on operation to the musical tone signal forming circuit 131 through the bus 150. The musical tone signal forming circuit 131 starts producing a musical tone signal at a tone pitch corresponding to the key represented by the key code data based on the received key data. In the comparison processing, if a new key-off operation on the keyboard 111 is detected, the CPU 142 supplies key data consisting of key code data that represents a key corresponding to the detected off-event and key-off data that represents the key-off operation to the musical tone signal forming circuit 131 through the bus 150. The musical tone signal forming circuit 131 sets the musical tone signal which is kept produced at the tone pitch corresponding to the key represented by the key code data in a decay state. In the above comparison processing, if no key-on nor key-off operation on the keyboard 111 is detected, the CPU 142 ends the processing of step 170 without executing the output processing of the key data. When new key-on and key-off operations on the keyboard 111 are detected as described above, the CPU 142 updates the key-status data associated with the keys corresponding to the key-on and key-off events, which is stored in the register group 144*i* in accordance with the derived latest key-status data in step 170, so as to prepare for the next comparison processing of the key-status data.

After the processing of step 170, the CPU 142 returns the program to step 110, and repetitively executes the loop of steps 110, 111, 120, 121, 130, 140, 150 to 152, 160, 161, and 170, so as to control the states of the musical tone signal formed by the musical tone signal forming circuit 131 in accordance with the operations of the keyboard 111 and the operation member groups 121 to 124 and updates the content of the data memory 144. If the interrupt command signal is supplied from the timer circuit 146 to the CPU 142 during the loop processing, the CPU 142 executes a "timer interrupt" program corresponding to the flow chart shown in FIG. 32 (to be described later). Thus, the CPU 142 writes the after-touch data AFT from the after-touch detector 113 in the register 144*e*, and converts the data AFT into vibrato depth data VIBDEP for controlling a vibrato depth added to a musical tone, based on the lower-limit data MIN(1) to MIN(N) and upper-limit data MAX(1) to MAX(N) respectively stored in the register groups 144*f* and 144*g*. The CPU 142 then outputs the data VIBDEP to the musical tone signal forming circuit 131. In this manner, the CPU 142 controls the states of the musical tones to be generated according to after touches on the keyboard 111.

The operations when the tone color selection operation member group 121, the touch vibrato switch 123*a*, and the multi-menu data setting operation member group 124 are operated and when the timer circuit 146 generates the interrupt command signal will be described in detail with reference to the flow charts shown in FIGS. 23, 24, 27 to 31, and 32.

WHEN TONE COLOR SELECTION OPERATION MEMBER GROUP 121 IS OPERATED

Figure 23:
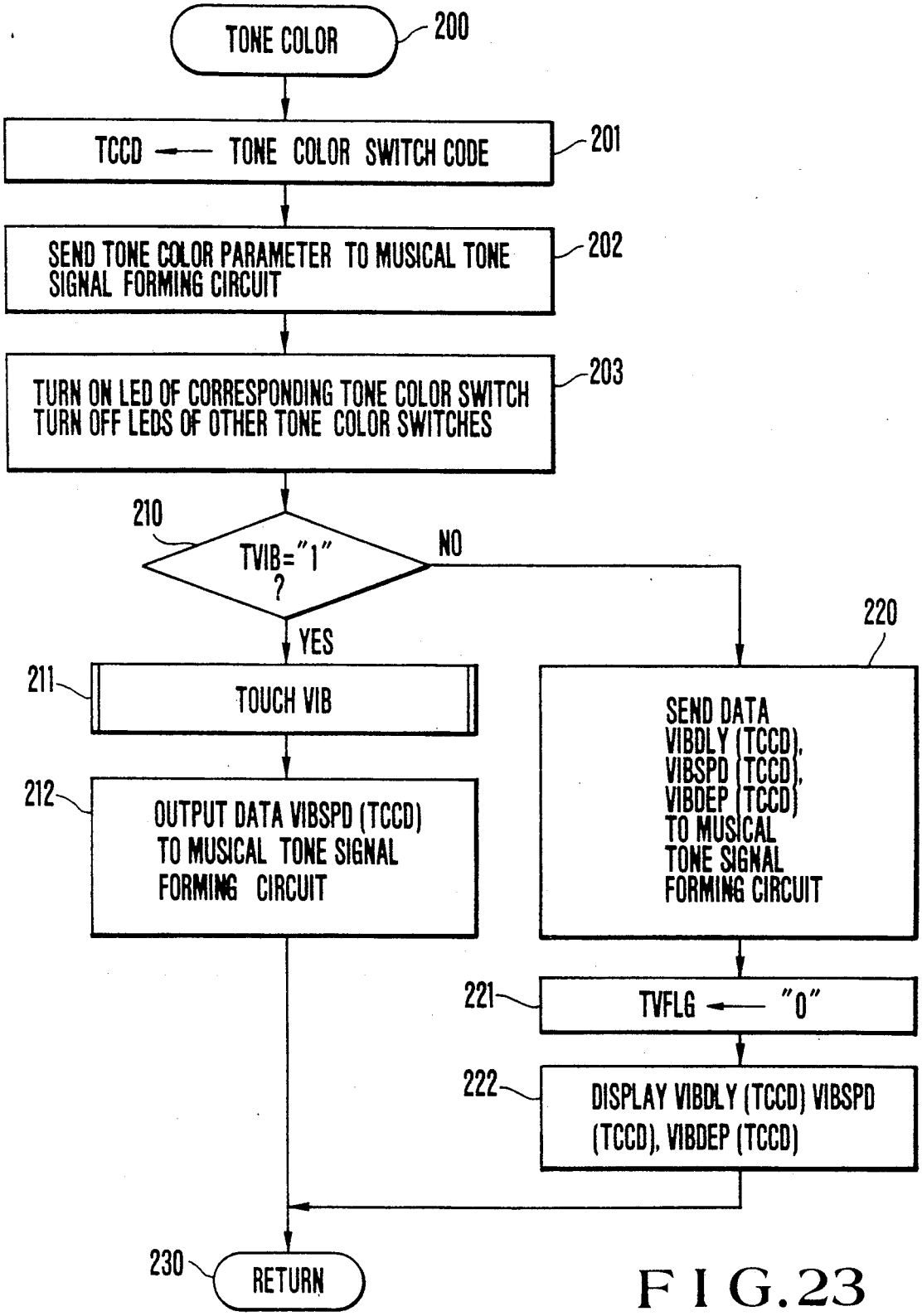

If any one of the tone color selection switches of the tone color selection operation member group 121 is turned on during the loop processing, since YES is obtained in step 110, the "TONE COLOR" program corresponding to the flow chart shown in FIG. 23 is executed in step 111. In the "TONE COLOR" program, the CPU 142 starts execution of the program in step 200, and writes a tone color code representing the tone color selection switch corresponding to the on-event in the register 144*a*, thereby updating the tone color code data TCCD in step 201. In step 202, the CPU 142 reads out a tone color parameter designated by the tone color code data TCCD from the memory area 145*d* of the parameter memory 145, and supplies the readout data to the musical tone signal forming circuit 131 through the bus 150. The musical tone signal forming circuit 131 generates a musical tone signal of a tone color corresponding to the tone color selection switch corresponding to the on-event. The CPU 142 supplies display control data to the display control circuit 127 through the bus 150 so as to turn on the display element incorporated in the tone color selection switch corresponding to the on-event and to turn off the display elements incorporated in the other tone color selection switches of the tone color selection operation member group 121, thereby controlling turn-on and turn-off operations of the display elements of the tone color selection switches. After the processing of step 203, the CPU 142 checks in step 210 if the touch vibrato data TVIB which is set in correspondence with the previous operation of the touch vibrato switch 123*a* is at logic "1".

Figure 24:
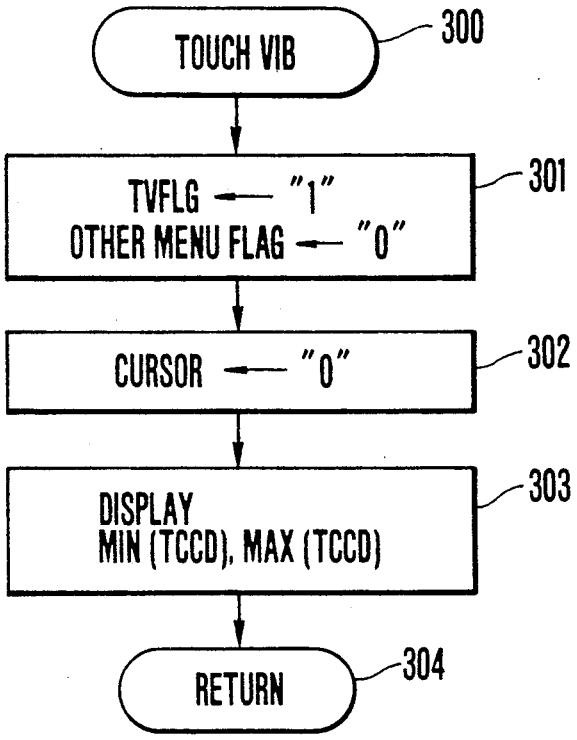
Figure 25:
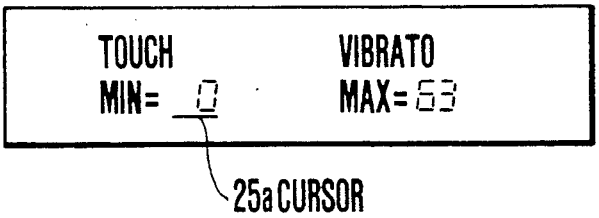
FIGS. 25 and 26 show display states of a display 125.

If it is determined that the touch vibrato data TVIB is at logic "1", that is, if key-touch vibrato control is selected, the CPU 142 determines YES in step 210, and executes the "TOUCH VIB" program corresponding to the flow chart shown in FIG. 24 in step 211. In this program, the CPU 142 starts execution of the program from step 300. In step 301, the CPU 142 sets the touch vibrato flag TVFLG at logic "1" and sets flags FLG other than the touch vibrato flag, which are stored in the register group 144*b*, at logic "0". In step 302, the CPU 142 sets the cursor position data CURSOR at logic "0". In step 303, the CPU 142 reads out the lower-limit data MIN(TCCD) and upper-limit data MAX(TCCD) designated by the tone color code data TCCD respectively from the register groups 144*f* and 144g, and outputs the data MIN(TCCD) and MAX(TCCD) to the display control circuit 127 through the bus 150 together with the cursor position data CURSOR. In step 304, the CPU 142 ends the execution of the "TOUCH VIB" program. In this case, the display control circuit 127 controls the display 125 based on the lower- and upper-limit data MIN(TCCD) and MAX(TCCD) and the cursor position data CURSOR, thereby display-controlling the display state of the display 125, as shown in FIG. 25. In FIG. 25, reference numeral 125a denotes a cursor. After execution of the "TOUCH VIB" program, the CPU 142 returns to the execution of the "TONE COLOR" program. In step 212, the CPU 142 reads out the vibrato speed data VIBSPD(TCCD) designated by the tone color code data TCCD from the memory area 145b of the parameter memory 145, and outputs the readout data to the vibrato control circuit 131a in the musical tone signal forming circuit 131 through the bus 150, thereby controlling the vibrato speed added to a musical tone signal. In this case, since the vibrato depth is controlled according to key touches, vibrato depth data VIBDEP and vibrato delay time data VIBDLY as one mode of the depth are not produced. When the touch vibrato data TVIB is at logic "1", if any tone color selection switch of the tone color selection operation member group 121 is turned on, the tone color of a musical tone is updated in accordance with the tone color selection switch corresponding to the on-event, and the touch vibrato flag TVFLG is set at logic "1", thereby allowing the multi-menu data setting operation member group 124 to set the lower-and upper-limit data MIN(TCCD) and MAX(TCCD) corresponding to the tone color. In addition, the display 125 displays the lower- and upper-limit data MIN(TCCD) and MAX(TCCD).

Figure 26:
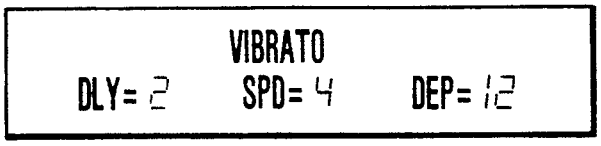

If it is determined in step 210 that the touch vibrato data TVIB is at logic "0", that is, if the key-touch vibrato control is not selected, the CPU 142 determines NO in step 210. In step 220, the CPU 142 reads out the vibrato delay time data VIBDLY(TCCD), vibrato speed data VIBSPD(TCCD), and vibrato depth data VIBDEP(TCCD) designated by the tone color code data TCCD respectively from the memory areas 145a, 145b, and 145c of the parameter memory 145, and supplies the readout data to the vibrato control circuit 131a in the musical tone signal forming circuit 131 through the bus 150, thereby controlling the vibrato delay time, speed, and depth added to the musical tone signal according to the tone color of a musical tone to be generated. In step 211, the CPU 142 sets the touch vibrato flag TVFLG at logic "0", and outputs the data VIBDLY(TCCD), VIBSPD(TCCD), and VIBDEP(TCCD) to the display control circuit 127 together with the touch vibrato flag TVFLG. At this time, the display control circuit 127 controls the display state on the display 125 as shown in FIG. 26 based on the supplied data. When the touch vibrato data TVIB is at logic "0", if any one of tone color selection switches of the tone color selection operation member group 121 is turned on, the tone color of a musical tone is updated according to the tone color selection switch corresponding to the on-event, and a vibrato suited for the tone color is added to the musical tone. In addition, the state of the vibrato is displayed on the display 125. After the processing of step 212 or 222, the execution of "TONE COLOR" program is ended in step 230.

WHEN TOUCH VIBRATO SWITCH 123a IS OPERATED

Figure 22:
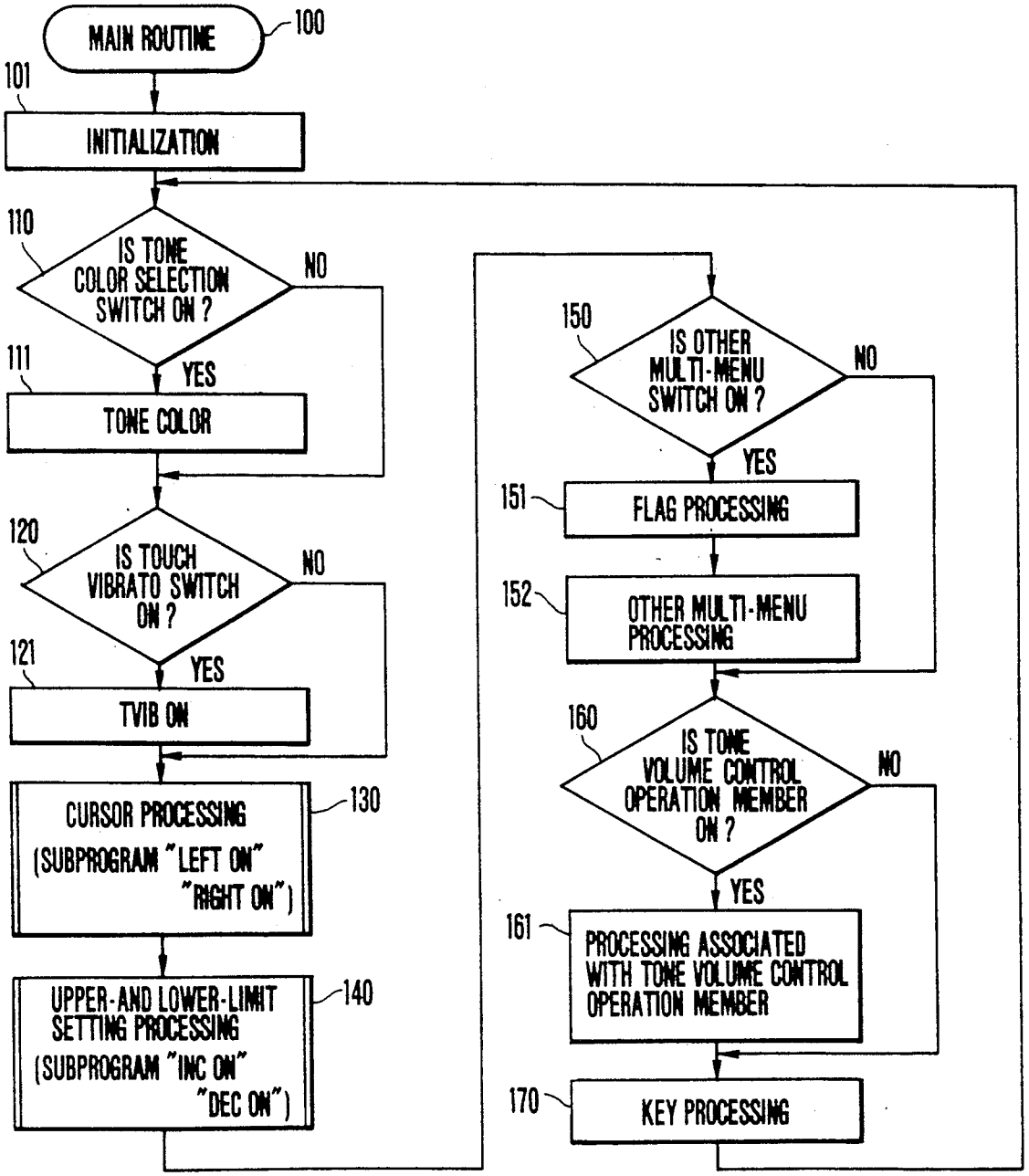
FIG. 22 to 24 are flow charts corresponding to a program executed by a microcomputer unit 140 shown in FIG. 18.
Figure 27:
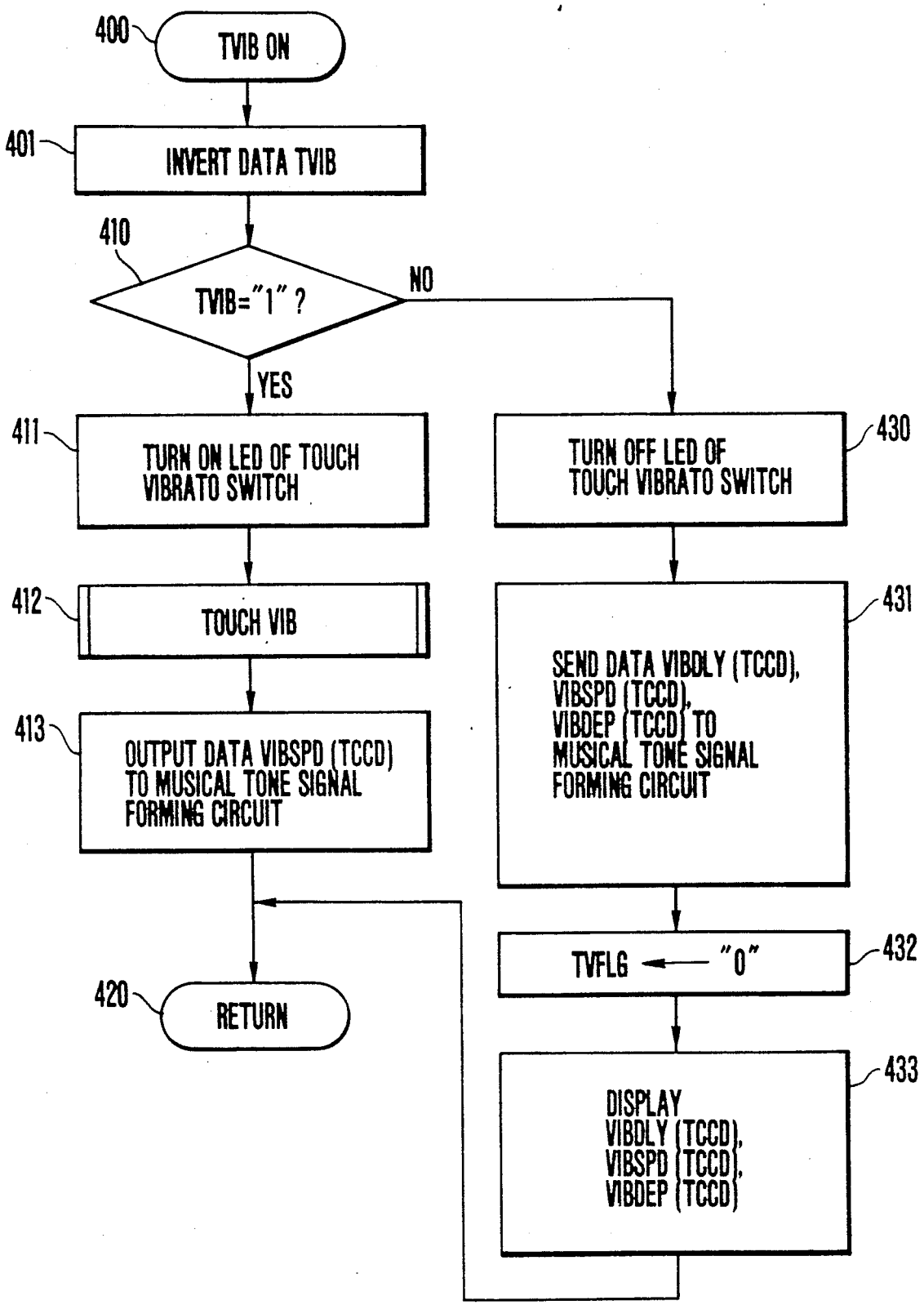
FIG. 27 to 32 are flow charts corresponding to a program, that is executed by the microcomputer unit 140 shown in FIG. 18.

When the touch vibrato switch 123a is turned on during the loop processing of the "main" program shown in FIG. 22, the CPU 142 determines YES in step 120, and executes the "TVIB ON" program corresponding to the flow chart shown in FIG. 27 in step 121. In the "TVIB ON" program, the CPU 142 starts execution of the program in step 400, and inverts the touch vibrato data TVIB in step 401. Upon inversion, since the touch vibrato data TVIB is inverted from logic "0" to logic "1" or from logic "1" to logic "0", key touch vibrato control can be selectively switched upon each on-event of the touch vibrato switch 123a. In step 410, the CPU 142 checks if the inverted touch vibrato data TVIB is at logic "1".

If the inverted touch vibrato data TVIB is at logic "1", that is, if the key touch vibrato control is selected, the CPU 142 determines YES in step 410, and outputs display control data for turning on the display element which is incorporated in the touch vibrato switch 123a to the display control circuit 127 through the bus 150 in step 411, thereby controlling the turn-on operation of the display element. In steps 412 and 413, the same processing as in steps 211 and 212 in FIG. 23 is executed, so that the lower- and upper-limit data MIN(TCCD) and MAX(TCCD) are updated in accordance with the operation of the multi-menu data setting operation member group 124 and are displayed on the display 125. The CPU 142 then ends the "TVIB ON" program in step 420.

If the touch vibrato data TVIB which is inverted in step 401 is at logic "0", that is, if the key touch vibrato control is canceled, the CPU 142 determines NO in step 410, and outputs the display control data to the display control circuit 127 through the bus 150 in step 430 so as to turn off the display element incorporated in the touch vibrato switch 123a, thereby controlling the turn-off operation of the display element. In steps 431 to 433, the same processing as in steps 220 to 222 shown in FIG. 23 is executed, the key touch vibrato control is canceled, and a vibrato suited for the currently selected tone color is added to musical tones. The addition state of the vibrato is displayed on the display 125. In step 420, the "TVIB ON" program is ended.

WHEN MULTI-MENU DATA SETTING OPERATION MEMBER GROUP 124 IS OPERATED

Figure 28:
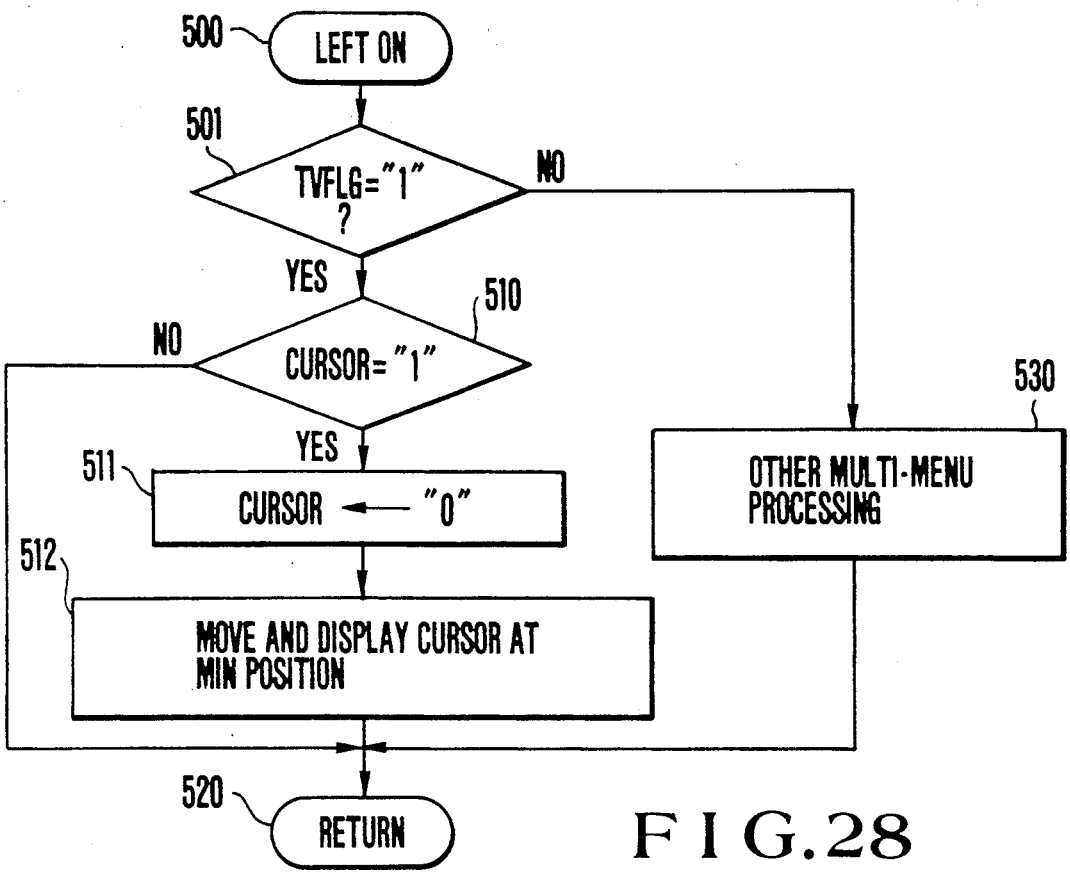
Figure 29:
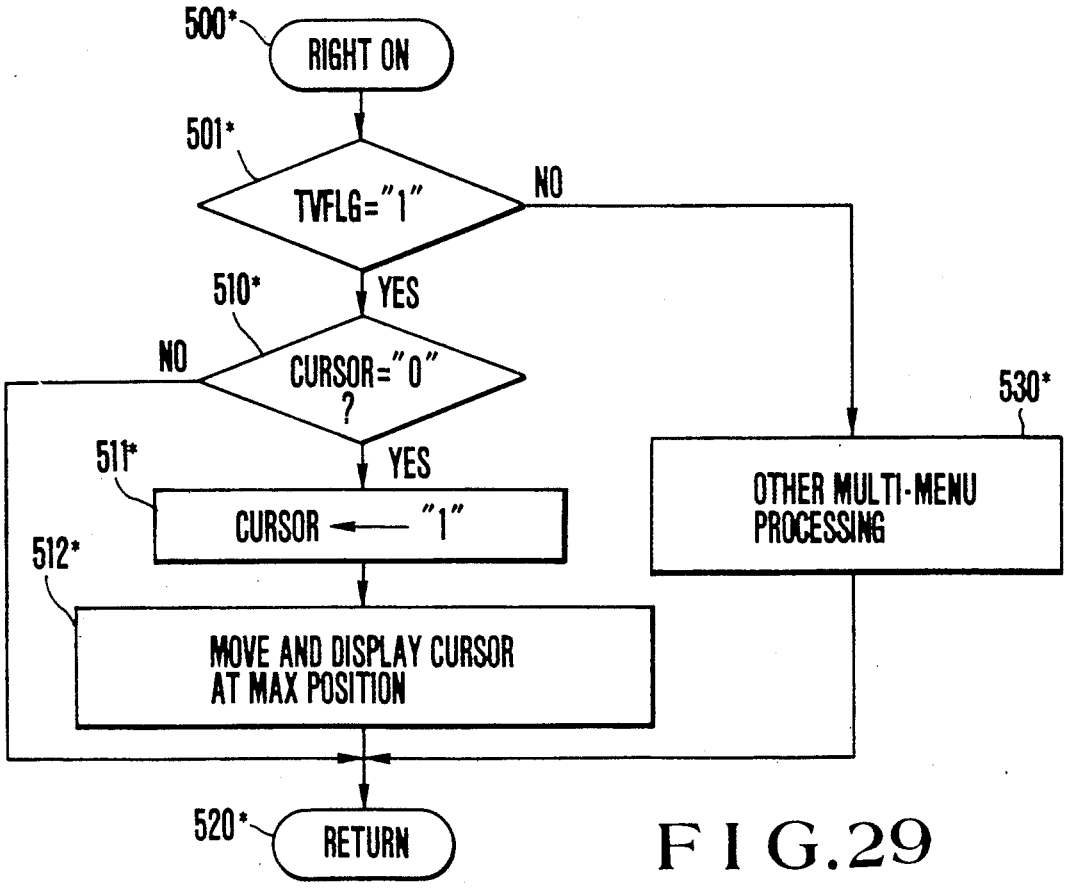

When the operation member 124a or 124b is turned on during the loop processing of the "main" program shown in FIG. 22, the CPU 142 executes the "LEFT ON" program corresponding to the flow chart shown in FIG. 28 or the "RIGHT ON" program corresponding to the flow chart of FIG. 29 in the cursor processing routine of step 130, thereby moving the cursor position shown in FIG. 25 to the left or right. More specifically, when the operation member 124a is turned on, the CPU 142 starts execution of the program from step 500 in FIG. 28, and checks in step 501 if the touch vibrato flag TVFLG is at logic "1". If the touch vibrato flag TVFLG is at logic "1", the CPU 142 determines YES in step 501, and sets data "0" as the cursor position data CURSO through the processing in steps 510 to 512. The CPU 142 controls the display control circuit 127, so that the display position of the cursor 125a (FIG. 25) on the display 125 is moved to the "left", i.e., a position at which the lower-limit data MIN(TCCD) is displayed. The "LEFT ON" program is ended in step 520. If the touch vibrato flag TVFLG is at logic "0", the CPU 142 determines NO in step 501, and executes another multi-menu associated processing in step 530. Then, the "LEFT ON" program is ended in step 520. Note that the processing of step 530 is not related directly to the present invention, and a description thereof is omitted.

If the operation member **124*b* is turned on, the CPU 142 executes the "RIGHT ON" program consisting of steps 500* to 530* shown in FIG. 29 (corresponding to step 500 to 530 in FIG. 28). If the touch vibrato flag TVFLG is at logic "1", the CPU 142 sets data "1" as the cursor position data CURSOR, and controls the display control circuit 127, so that the display position of the cursor 125*a* on the display 125** is moved to the "right", i.e., to a position at which the upper-limit data MAX(TCCD) is displayed.

Figure 30:
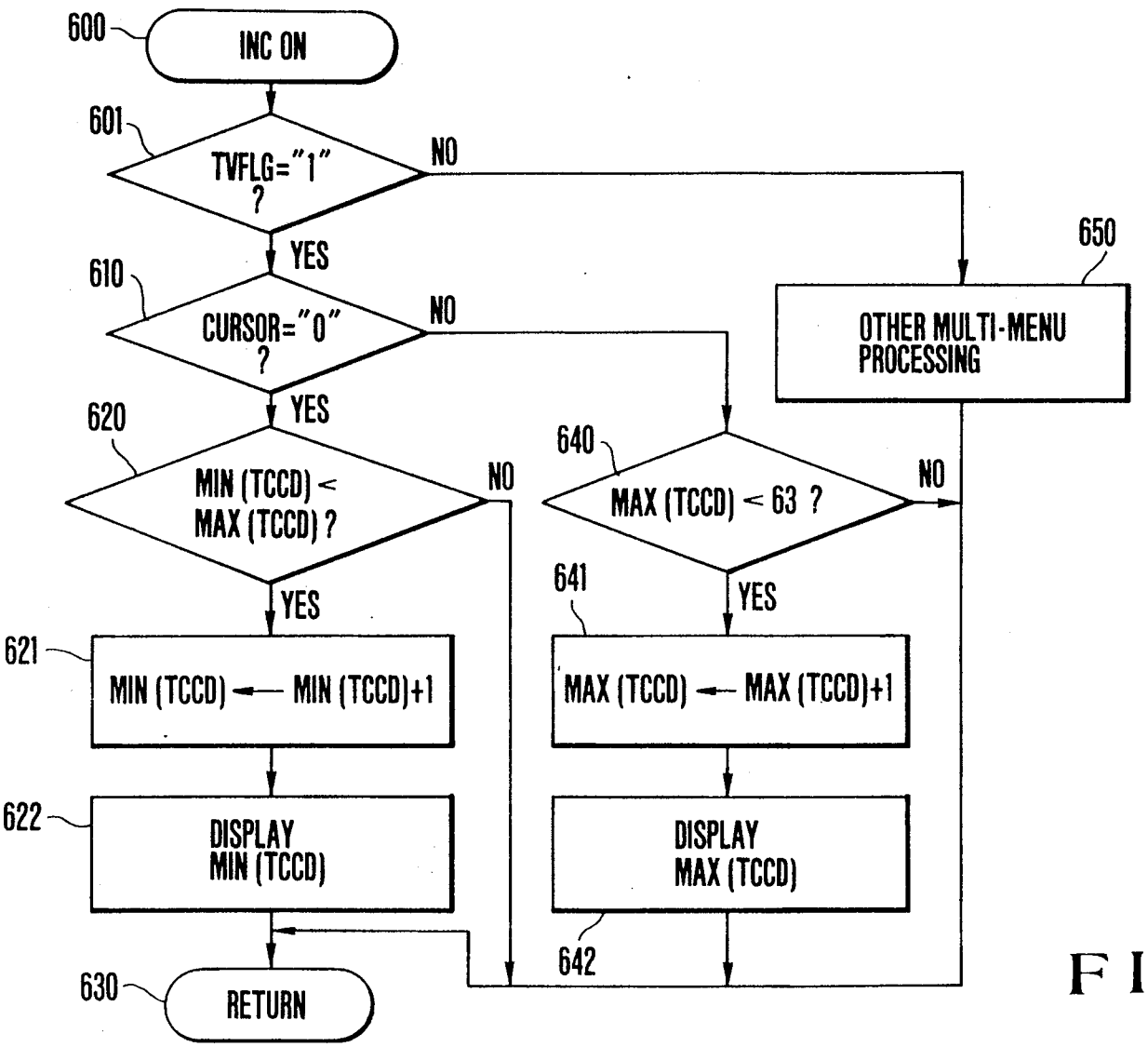
Figure 31:
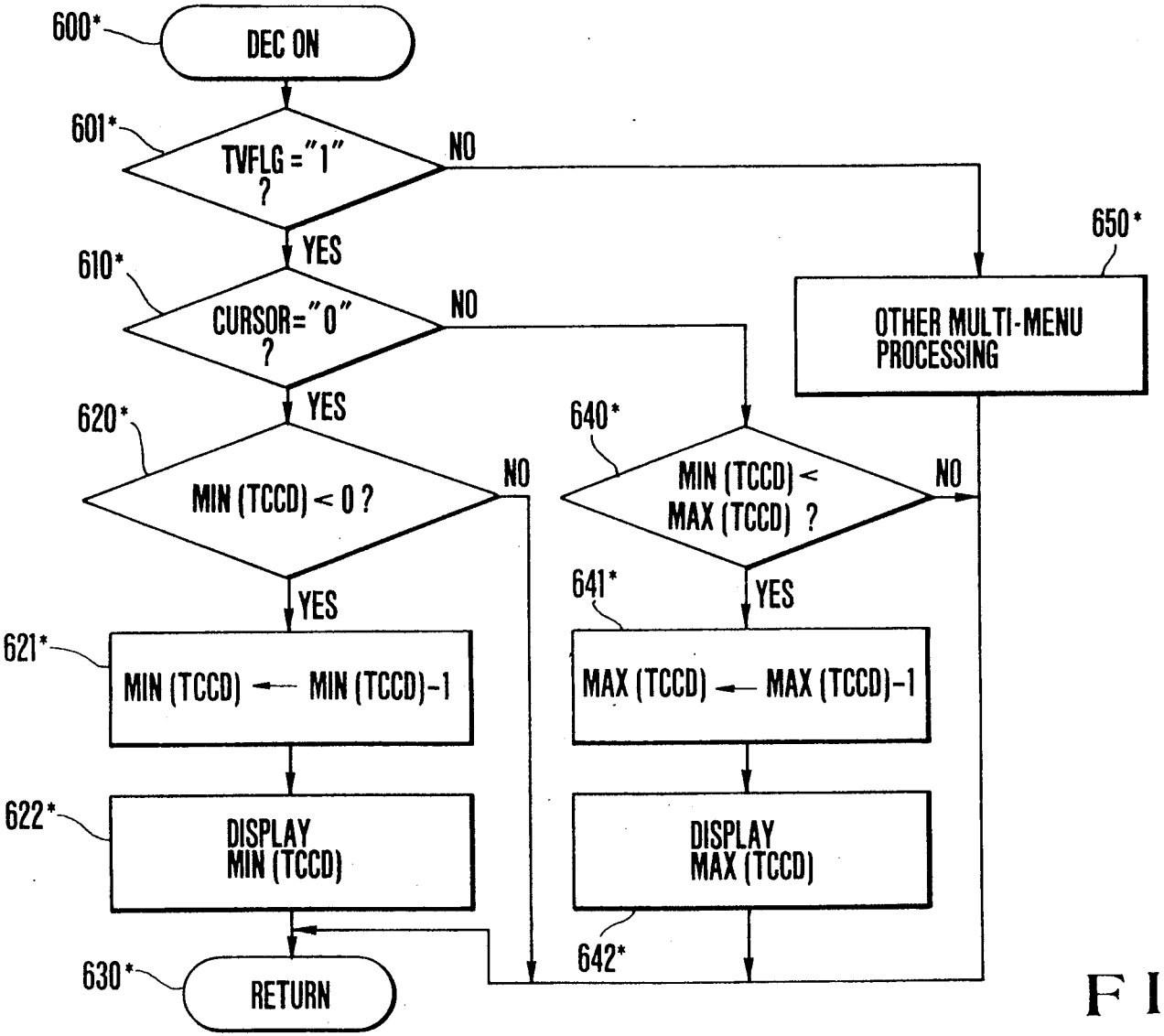

When the operation member **124*c* or 124*d* is operated during the loop processing of the "main" program shown in FIG. 22, the CPU 142 executes the "INC ON" program corresponding to the flow chart shown in FIG. 30 or the "DEC ON" program shown in FIG. 31 in the upper/lower limit setting processing routine of step 140. The CPU 142 thus updates the lower-limit data MIN(TCCD) and the upper-limit data MAX(TCCD), and causes the display 125 to display these data. More specifically, when the operation member 124*c* is turned on, the CPU 142 starts execution of the program from step 600, and checks in step 601 if the touch vibrato flag TVFLG is at logic "1". If the touch vibrato flag is at logic "1", the CPU 142 determines YES in step 601, and determines the display position of the cursor 125*a* (FIG. 25) in accordance with the value of the cursor position data CURSOR. If the cursor position data CURSOR is "0", i.e., if the cursor 125*a* indicates the display position of the lower-limit data MIN(TCCD),. the CPU 142 determines YES in step 610, and increments the lower-limit data MIN(TCCD) by "1" so as not to exceed the upper-limit data MAX(TCCD) through the processing in steps 620 to 622. The CPU 142 also controls the display control circuit 127, so that the incremented lower-limit data MIN(TCCD) is displayed on the display 125. In step 630, the "INC ON" program is ended. If the cursor position data CURSOR indicates "1", that is, if the cursor 125*a* indicates the display position of the upper-limit data MAX(TCCD), the CPU 142 determines NO in step 610. The CPU 142 then increments the upper-limit data MAX(TCCD) by "1" so as not to exceed "63" through the processing in steps 640 to 642. In addition, the CPU 142 controls the display control circuit 127, so that the increment upper-limit data MAX(TCCD) is displayed on the display 125. In step 630, the "INC ON" program is ended. If the touch vibrato flag TVFLG is at logic "0", the CPU 142 determines NO in step 601, and executes the another multi-menu associated processing in step 650. In step 630, the "INC ON" program is ended. Note that the processing of step 650** is not related directly to the present invention, and a description thereof is omitted.

When the operation member **124*d* is operated, the CPU 142 executes the "DEC ON" program consisting of steps 600* to 650* shown in FIG. 31 (corresponding to steps 600 to 650 in FIG. 30). If the touch vibrato flag TVFLG is at logic "1", the CPU 142 decrements the lower-limit data MIN(TCCD) by "1" if it is larger than "0" in accordance with the value of the cursor position data CURSOR, or decrements the upper-limit data MAX(TCCD) by "1" if it exceeds the lower-limit data, and causes the display 125** to display the decremented lower- or upper-limit data MIN(TCCD) and MAX(TCCD).

WHEN TIMER CIRCUIT 146 GENERATES INTERRUPT COMMAND SIGNAL

Figure 32:
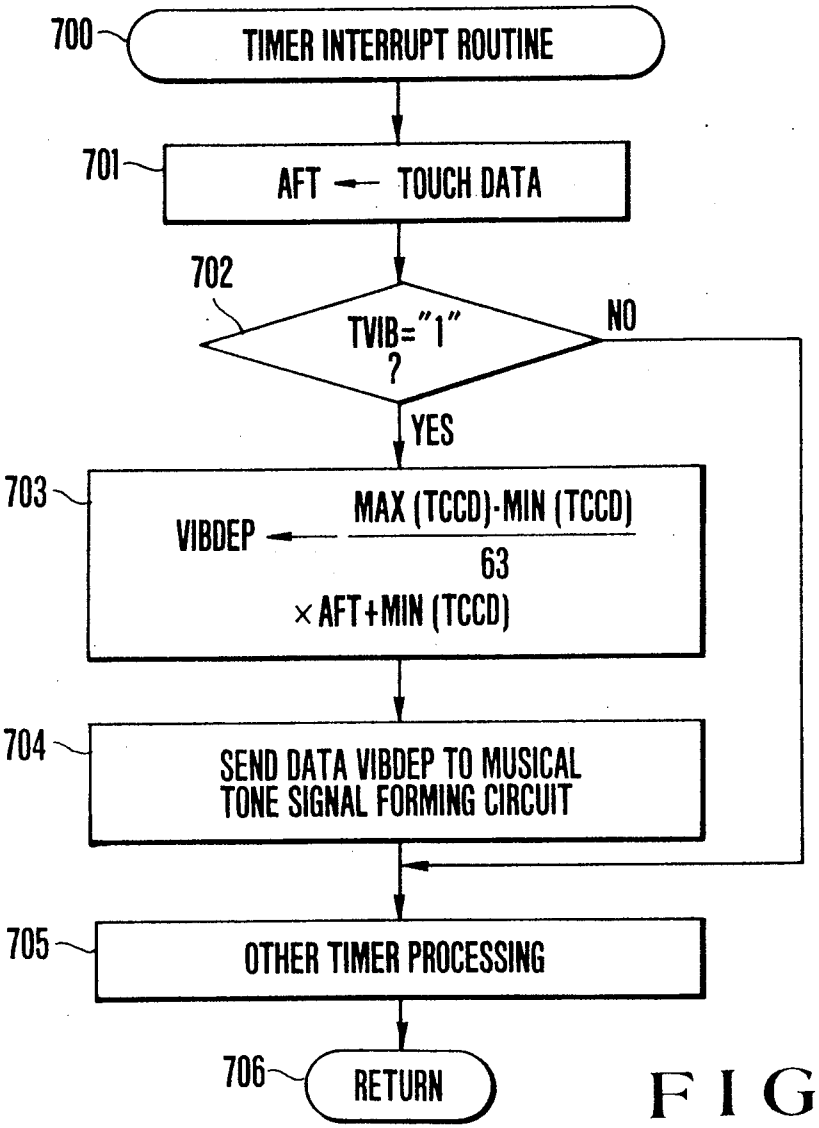

When the timer circuit 146 supplies the interrupt command signal to the CPU 142 through the bus 150 during the loop processing of the "main" program shown in FIG. 22, the CPU 142 interrupts the loop processing and executes the "timer interrupt" program corresponding to the flow chart shown in FIG. 32. In the "timer interrupt" program, the CPU 142 starts execution of the program in step 700. In step 701, the CPU 142 outputs a touch data derive control signal to the after-touch detector 113 through the bus 150. The CPU 142 thus derives the after-touch data AFT from the detector 113 and stores the derived data in the register **144*e*. The CPU 142 checks in step 702 if the touch vibrato data TVIB is at logic "1". If the touch vibrato data TVIB is at logic "1", the CPU 142 determines YES in step 702, and, in step 703**, calculates the vibrato depth data VIBDEP based on the lower- and upper-limit data MIN(TCCD) and MAX(TCCD) designated by the tone color code data TCCD using the following equation:

$$VIBDEP = AFT \times (MAX(TCCD) - MIN(TCCD))/63 + MIN(TCCD)$$

Figure 33:
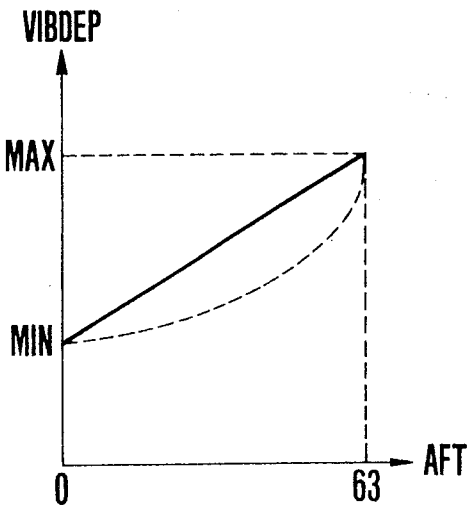
FIG. 33 is a graph showing a change in key touch.

In this equation, since the after-touch data AFT varies within the range of "0" to "63", the vibrato depth data VIBDE linearly changes between the lower- and upper-limit data MIN(TCCD) and MAX(TCCD) upon change in after-touch data AFT, as indicated by the solid line in FIG. 33, and its inclination corresponds to a value which is set according to the difference between the lower- and upper-limit data MIN(TCCD) and MAX(TCCD). In step 704, the CPU 142 supplies the vibrato depth data VIBDEP to the vibrato control circuit **131*a* of the musical tone signal forming circuit 131 through the bus 150, so as to control the vibrato depth added to the musical tone signal. In step 705, the CPU 142 outputs, e.g., tone volume control data based on the after-touch data AFT to the musical tone signal forming circuit 131 through the bus 150, thus executing the other timer processing. In step 706, the "timer interrupt" program is ended. If the touch vibrato data TVIB is at logic "0", the CPU 142 determines NO in step 702, and executes the processing of step 705. Then, the CPU 142 ends the "timer interrupt" program in step 706**.

The "timer interrupt" program is executed during a time interval where a change in after-touch data indicating an after-touch is not aurally noticeable. Therefore, the vibrato depth added to the musical tone to be generated can be accurately controlled in accordance with an after touch of the key-on operation.

As can be understood from the above description, the after-touch data AFT indicating the after-touch detected by the after-touch detector 113 is converted to vibrato depth data VIBDEP for controlling the vibrato depth through the processing of step 703 shown in FIG. 32. As the result of conversion, a range of change in vibrato depth data VIBDEP is determined based on the lower- and upper-limit data which is set by the performer using the multi-menu data setting operation member group 124, and its changing ratio is determined in accordance with the difference between the lower- and upper-limit data. Therefore, when the performer sets the lower- and upper-limit data, the range and the after-touch sensitivity of vibrato depth which are controlled by an after touch are determined accordingly. Even if basic key depression forces of performers differ like a male adult and child, the vibrato effect by an after touch can be stably controlled. The margin of vibrato effect control by the after touch in the favor of the performer can be widened, and performance expression of the electronic musical instrument can be improved. If the range of change is decreased, the changing ratio is also decreased, so that the after-touch data AFT is converted to the vibrato depth data VIBDEP over the entire range ("0" to "63"). Therefore, the after-touch data within the entire range detected by the after-touch detector 113 can be used for vibrato depth control. In addition, delicate vibrato depth control based on the after touch is easily attained, and performance expression o the electronic musical instrument can be improved. Linear conversion characteristics from the after-touch data AFT to the vibrato depth data VIBDEP based on the lower- and upper-limit data set by the performer can be set along a line connecting the lower- and upper-limit data, as shown in FIG. 33. Therefore, the performer can easily grasp and set the conversion characteristics.

The lower- and upper-limit data for determining the conversion characteristics are set and stored in the register groups 144*f* and 144*g* for each tone color, and are used in response to tone color selection. Therefore, when the lower- and upper-limit data are set for several tone colors used in the performance before the performance, the lower- and upper-limit data need not be changed if the tone colors are updated during the performance, thus improving the performance of the electronic musical instrument.

The following modifications of the present invention can be made.

In the above embodiment when the lower- and upper-limit data are set, a data value is incremented or decremented by one each time the operation member 124*c* or 124*d* is turned on. However, numerical keys corresponding to "0" to "9" can be arranged so as to set the lower- and upper-limit data.

In the above embodiment, the conversion characteristics from the after-touch data AFT to the vibrato depth data VIBDEP are determined by a linear function. However, the characteristics can be determined using a quadratic or cubic function, as indicated by the broken line in FIG. 33. The relationship between the lower- and upper-limit data can be reversed, so that the vibrato depth data VIBDEP is decreased as the after-touch data AFT increases, thereby attaining a unique performance effect by key touches. In the above embodiment, data conversion is performed by an arithmetic operation. However, a conversion table comprising a ROM can be arranged, so that the vibrato depth data VIBDEP is read out using the after-touch data AFT as an address, thereby achieving high-speed data conversion.

In the above embodiment, the vibrato depth added to the musical tone is controlled directly by the vibrato depth data which is converted from the after-touch data AFT. A low-pass filter can be arranged midway along a circuit between the after-touch detector 113 and the vibrato control circuit 131*a* , or the after-touch data AFT or the vibrato depth data VIBDEP can be subjected to an arithmetic operation function equivalent to a low-pass filter function. Even if the performer erroneously changes a key touch abruptly, the influence of the key touch to the musical tone state can be moderated. Instead of the low-pass filter or the arithmetic operation function, changing characteristics of the after-touch data or the vibrato depth data VIBDEP can be changed using a data converter for moderating the following characteristics of the after-touch data at only its trailing edge or an arithmetic means equivalent to the converter, as described in Japanese Patent Prepublication No. 53-102729. Thus, the performer can easily control the state of the musical tone based on the after touch, as described in the prepublication.

In the above embodiment, only the vibrato depth is controlled based on data obtained by converting the after-touch data AFT. The vibrato speed can be controlled based on the converted data or both the vibrato depth and speed can be controlled. The present invention is not limited to a vibrato effect, but can be applied to control of effect signals for, e.g., tone color, pitch, tone volume, tremolo, wow, and the like.

In the above embodiment, musical tone state control by means of an after touch has been described. The present invention can be applied to an electronic musical instrument, in which an initial touch detector for detecting a key depression speed is arranged instead of the after-touch detector 113, and the musical tone state is controlled in accordance with an initial touch. In the above embodiment, the key touch sensor common to the keys of the keyboard 111 is arranged, and the states of musical tones generated by the musical tone generator 130 are commonly controlled by the sensor output. However, key touch sensors can be arranged for each key, and the state of each musical tone produced upon key-on operation can be independently controlled by the key touch sensor output for each key.

According to the present invention as can be understood from the above description, the performer can desirably set first and second control data by a data setting means, so as to control not only a changing range of musical tone control data which changes in accordance with key touches and controls a state of a musical tone signal but also a changing ratio (touch sensitivity) of the musical tone control data with respect to a key touch. As a result, even when basic key depression forces of performers differ like a male adult and child, the same effect as in a conventional apparatus can be achieved, and a touch response sensitivity can be controlled in correspondence with the difference in basic key depression forces. Therefore, for a person whose basic key depression force is strong, delicate status control of the musical tone signal can be facilitated. On the other hand, for a person whose basic key depression force is weak, a dynamic performance utilizing strengths of key touches is enabled. As described above, a changing ratio of musical tone control data with respect to a key touch can be updated in accordance with a difference between the first and second control data. Thus, even if a changing range of the musical tone control data is decreased, key touches over all the changing range can be converted to the musical tone control data, and the state of the musical tone signal can be controlled in accordance with key touches over all the changing range. Therefore, the range of key touches will not be decreased according to conversion conditions from key touches to musical tone control data unlike the conventional apparatus. For these reasons, the state of the musical tone signal can be satisfactorily controlled according to key touches, and a performance expression of the electronic musical instrument can be improved.

According to the present invention, when the performer inputs first and second control data respectively indicating first and second values using the data setting means, a changing range of musical tone control data and a changing ratio of the musical tone control data can be set. In addition, the upper and lower limits of the changing range corresponds to the first and second value, and the changing ratio corresponds to the difference between the first and second values. Therefore, the performer can easily grasp the relationship between the first and second control data and the changing range and the changing ratio, and can easily input the first and second control data.

What is claimed is:

1. An electronic musical instrument having a keyboard, comprising:

a plurality of keys;

a plurality of musical tone signal generation systems, to which different tone groups are assigned respectively for respectively generating musical tone signals each having a tone pitch corresponding to a depressed key among said keys and having a tone color belonging to an assigned tone group, each of said tone groups including at least two tone colors having parameters representing predetermined characteristics of musical tones, at least two tone groups in said tone groups being selected under one key depression to generate at least two tones of said selected tone groups;

touch data producing means for producing touch data representing a degree of depression of said depressed key;

touch sensitivity setting means for setting respective touch sensitivities representing sensitivity to a key touch for said musical tone signal generation systems;

touch data modifying means for modifying said touch data in accordance with each of said touch sensitivities and for delivering modified touch data for each of said musical tone signal generating systems; and control means for controlling a characteristic of each of said musical tone signals in accordance with a corresponding one of said modified touch data.

2. An electronic musical instrument according to claim 1, wherein each of said touch sensitivities is one of predetermined plural touch sensitivities.

3. An electronic musical instrument according to claim 1, wherein said musical tone groups comprise a first tone group consisting of tone colors characterizing continuous tones and second tone group consisting of tone colors characterizing percussive tones.

4. An electronic musical instrument according to claim 1, wherein the touch data includes at least one of initial touch data representing a degree of depression at an initial stage of depression of said depressed key and after touch data representing a degree of depression strength while said depressed key is being depressed.

5. An electronic musical instrument according to claim 1, wherein the modified touch data represents a mixing ratio of two waveforms, which correspond to predetermined different two degrees of key depression, generated in each of said musical tone signal generation systems.

6. An electronic musical instrument according to claim 1, further comprising:

comparing means for comparing said after touch data with a value determing present touch responsive condition and generating a comparison result; and means for incrementing or decrementing said value in accordance with the comparison result between said after touch data and said value.

7. An electronic musical instrument according to claim 1, further comprising:

a preset switch for prestoring said touch sensitivities.

8. An electronic musical instrument having a keyboard, comprising:

a plurality of keys;

touch data generating means for generating touch data representing a degree of depression of a depressed key;

value setting means for setting first and second values;

touch sensitivity setting means for setting touch sensitivities representing a sensitivity to a key touch, an upper-limit and a lower-limit of each of said touch sensitivities corresponding to said first value and said second value respectively;

touch data modifying means for modifying said touch data in accordance with said touch sensitivities corresponding to a predetermined relation representing a relation between said touch data and said touch sensitivities and for delivering modified touch data;

musical tone signal generating means for generating a musical tone signal having a pitch corresponding to said depressed key; and control means for controlling a characteristic of said musical tone signal in accordance with said modified touch data.

9. An electronic musical instrument according to claim 8, wherein a ratio of sensitivity and key touch specifying said touch sensitivity is determined by a difference between said preset upper- and lower-limits.

10. An electronic musical instrument according to claim 8, wherein the touch data includes at least one of initial touch data representing a degree of depression at an initial stage of depression of said depressed key and after touch data representing a degree of depression strength while said depressed key is being depressed.

11. An electronic musical instrument according to claim 10, wherein said touch data is data proportional to a maximum key depression depth.

12. An electronic musical instrument according to claim 10, wherein said touch data is data proportional to a maximum key depression pressure.

13. An electronic musical instrument according to claim 8, wherein said touch sensitivity setting means comprises a display and a plurality of operation elements for moving a cursor on said display, so that the touch sensitivity is set in accordance with the position of the cursor on said display.

* * * * *

UNITED STATES PATENT AND TRADEMARK OFFICE

CERTIFICATE OF CORRECTION

PATENT NO. : 5,027,690

DATED : July 2, 1991

INVENTOR(S) : Wachi et al.

It is certified that error appears in the above-identified patent and that said Letters Patent is hereby corrected as shown below:

| | | |
|---|---|---|
| col. 31, line 21 | delete "o" | insert --of-- |

Signed and Sealed this

Fifteenth Day of March, 1994

*Attest:*

*Attesting Officer*

BRUCE LEHMAN

*Commissioner of Patents and Trademarks*